US005373097A

United States Patent [19]

Mizuno et al.

[11] Patent Number: 5,373,097

[45] Date of Patent: Dec. 13, 1994

[54] ELECTRONIC MUSICAL INSTRUMENT FOR CONTROLLING MUSICAL TONE WITH OPERATIONAL DATA IN THE SEQUENCE OF RECORDING OF SUCH DATA

[75] Inventors: Kotaro Mizuno; Yasushi Kurakake; Yasushi Sakurai, all of Hamamatsu, Japan

[73] Assignee: Yamaha Corporation, Hamamatsu, Japan

[21] Appl. No.: 89,899

[22] Filed: Jul. 9, 1993

Related U.S. Application Data

[63] Continuation of Ser. No. 642,678, Jan. 17, 1991, abandoned.

[30] Foreign Application Priority Data

Jan. 18, 1990 [JP] Japan ..... 2-9077

[51] Int. Cl.[5] ..... G10H 1/02

[52] U.S. Cl. ..... 84/615; 84/622; 84/661

[58] Field of Search ..... 84/615, 622, 661, DIG. 9

[56] References Cited

U.S. PATENT DOCUMENTS

| | | | |
|---|---|---|---|
| 4,779,505 | 10/1988 | Suzuki | 84/622 |
| 4,785,706 | 11/1988 | Toshifumi | 84/DIG. 10 |
| 4,907,484 | 3/1990 | Suzuki et al. | 84/661 |
| 4,980,519 | 12/1990 | Mathews | 178/19 |
| 5,005,460 | 4/1991 | Suzuki et al. | 84/600 |

FOREIGN PATENT DOCUMENTS

| | | |
|---|---|---|
| 58-9435 | 2/1983 | Japan . |
| 59-37518 | 9/1984 | Japan . |

*Primary Examiner*—William M. Shoop, Jr.
*Assistant Examiner*—Brian Sircus
*Attorney, Agent, or Firm*—Spensley Horn Jubas & Lubitz

[57] ABSTRACT

An electronic musical instrument is disclosed wherein the musical tone parameter such as the tone volume, tone color, acoustic reverberation, pan-pot and the like can be varied over time. The invention provides an electronic musical instrument including an operational device, a memory, a readout section, a control section and a tone generator. The operational device can be implemented in a stick type operator for example. The operational device generates operational data which vary over time in response to operations applied thereto. The operational data generated by operational device are consecutively stored in the memory. The readout section can be implemented in a CPU for example and consecutively reads out the operational data from the memory. The control section can be implemented in a CPU for example and generates a musical tone parameter which varies over time on the basis of data consecutively read out from the memory. The tone generator generates musical tones on the basis of a musical tone parameter. In this electronic musical instrument, the musical tone parameter of generated musical tones can be continuously varied over time in response to the operational data which are consecutively read out from the memory.

9 Claims, 18 Drawing Sheets

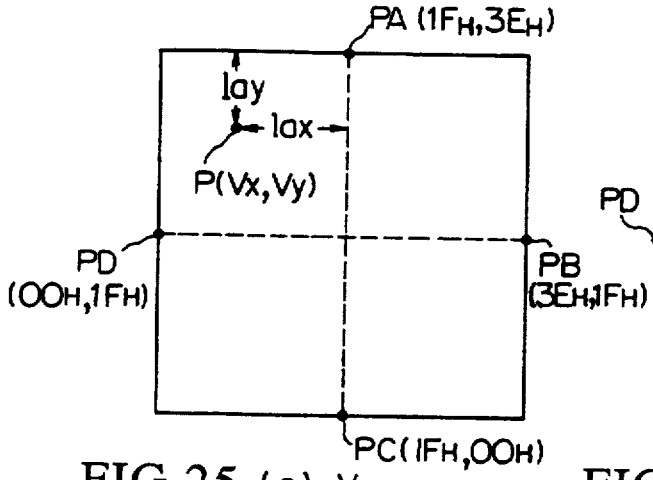
FIG.25 (a) $V_1$
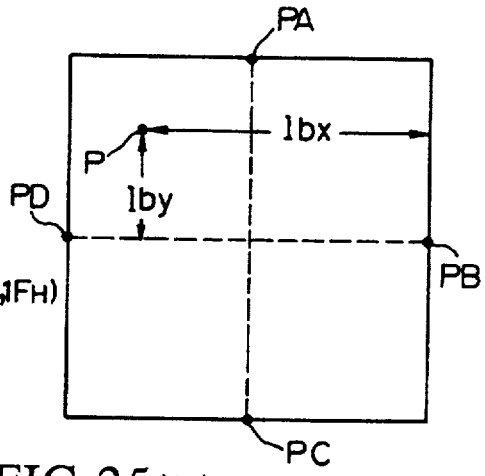
FIG.25 (b) $V_2$
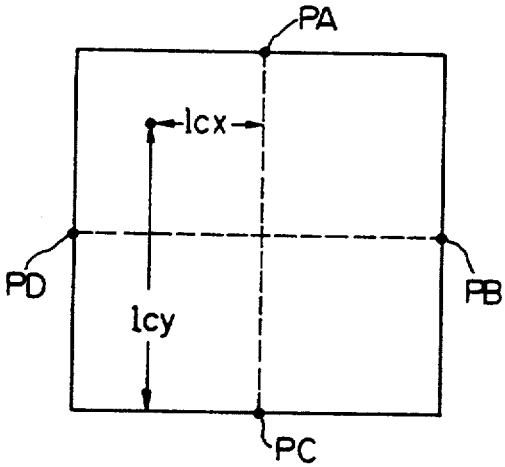
FIG.25 (c) $V_3$
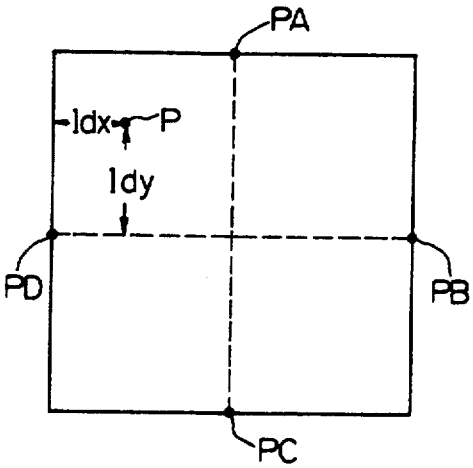
FIG.25 (d) $V_4$

ELECTRONIC MUSICAL INSTRUMENT FOR CONTROLLING MUSICAL TONE WITH OPERATIONAL DATA IN THE SEQUENCE OF RECORDING OF SUCH DATA

This is a file wrapper continuation of application Ser. No. 07/642,678 filed on Jan. 17, 1991, now abandoned.

BACKGROUND OF THE INVENTION

1. Field of the Invention

The present invention relates to electronic musical instruments which are capable of generating musical tones based on parameters such as tone volume, tone color, pan-pot and the like which are frequently varied in real time.

2. Prior Art

Electronic musical instruments are conventionally known in which operational elements for designating musical tone parameters such as tone volume, tone color, acoustic reverberation, pitch bend value, pan-pot and the like are provided, whereby operations on the desired operation factors, corresponding to a musical tone parameter can be set to desirable values so that the desired performance can be obtained.

In the conventional electronic musical instrument mentioned above, a performer can change the musical tone parameter as desired before performance or after performance by operating the corresponding operational element. However, it is difficult to change such musical tone parameters frequently in the midst of performance, particularly while sounding musical tone by depressing a key of key-board. Accordingly, there is a problem in that it is difficult to generate dynamic musical tones having parameters which vary over time.

SUMMARY OF THE INVENTION

It is accordingly an object of the present invention to provide an electronic musical instrument capable of generating a dynamic and realistic musical tone having parameters such as tone color, tone volume, acoustic reverberation, pan-pot and the like which are varied over time.

In an aspect of the present invention, there is provided an electronic musical instrument comprising:

- operational means for generating operational data based on operation of an operator element, such that said operational data varies with respect to time;
- memory means for sequentially storing said operational data;
- readout means for reading out said operational data from said memory means;
- control means for generating a musical tone parameter, such that said musical tone parameter is generated based on said operational data readout from said memory means by said readout means; and
- tone generating means for generating musical tone based on said musical tone parameter,
- whereby musical tone is generated, such that said musical tone corresponds to the operation of said operator element over time.

The other objects and features of the present invention will become understood from the following description with reference to accompanying drawings.

BRIEF DESCRIPTION OF THE DRAWING

FIGS. 25(*a*) through 25(*d*) show operations carried out on joy-stick operational data which are used for the preferred embodiment shown in FIG. 1;

DESCRIPTION OF PREFERRED EMBODIMENTS

Hereinafter, description will be given with respect to preferred embodiments of the electronic musical instrument according to the present invention.

Figure 1:
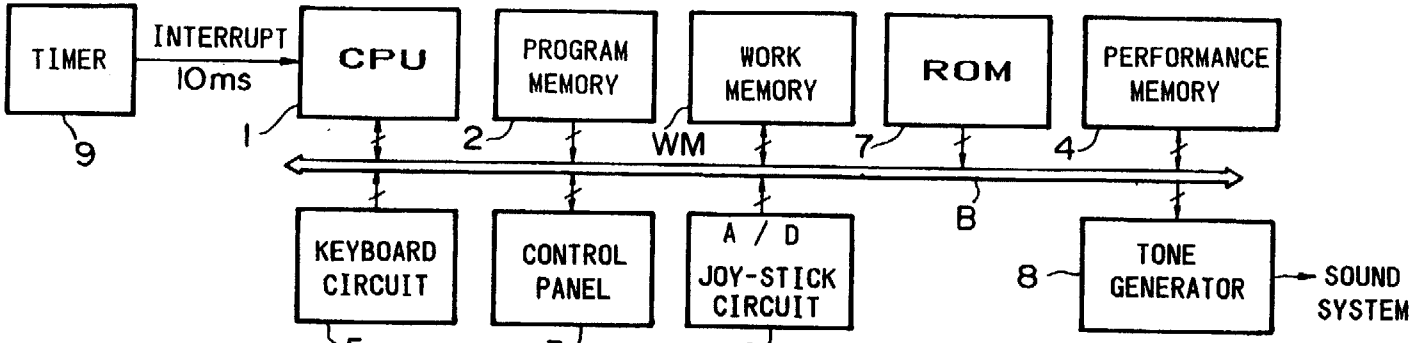
FIG. 1 is a block diagram showing configuration of a electronic musical instrument according to a preferred embodiment of the present invention.
Figure 2:
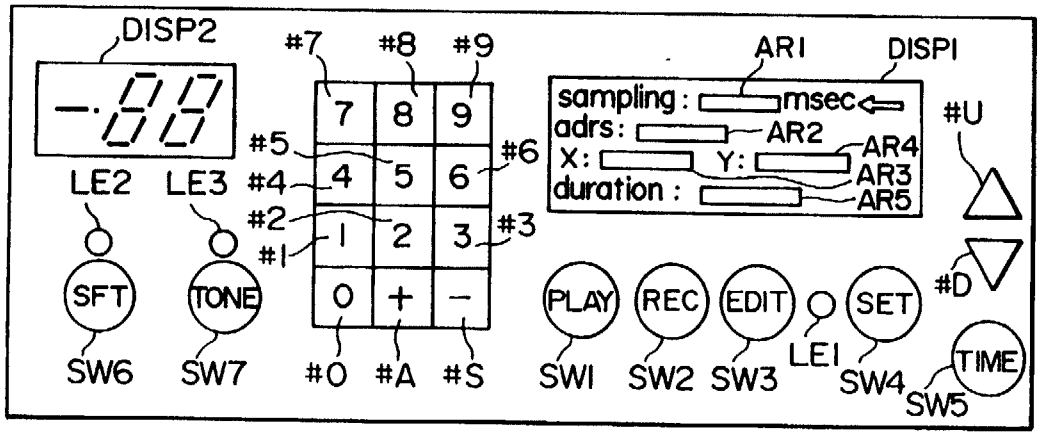
FIG. 2 shows top view of a control panel 3 provided in the preferred embodiment shown in FIG. 1.

FIG. 1 is a block diagram showing the configuration of an electronic musical instrument of a preferred embodiment of the present invention. In FIG. 1, 1 designates a CPU (central processor unit) which controls the other components provided in this electronic musical instrument. 2 designates a program memory which is implemented in ROM (read only memory) for example. In this program memory 2, plural control programs which are executed by CPU 1 are stored. WM designates a work memory which is implemented in RAM (random access memory). Memory locations of this work memory WM are used by CPU 1 as control data areas, control tables or control flags. 3 designates a control panel in which plural operational elements and displays are provided as shown in FIG. 2.

4 designates a performance memory which is implemented in RAM for example. This performance memory 4 is used for storing event data which control musical tone. The event data will be described later on. 5 designates a key-board circuit which is connected with a key-board (not shown) having plural keys. These keys are respectively connected with key-switches. The key-board circuit includes a key detection circuit by which the on/off states of key-switches are respectively detected. The key-board circuit outputs the key-on events and key-off events in response to the detected on/off states of key-switches. 6 designates a joy-stick device. The joy-stick device 6 includes a joy-stick (not shown), a joy-stick circuit (not shown) and an A/D (Analog/-Digital) converter. The movements of joy-stick along X-axis and Y-axis are measured by the joy-stick circuit. The joy-stick circuit outputs analog signals in response to the measured movements of Joy-stick. The output analog signals are converted to digital data by the A/D converter. The converted digital data are outputted from A/D converter as X-directional and Y-directional joy-stick operational data which respectively corresponding to X-directional and Y-directional movements of joy-stick. X-directional and Y-directional joy-stick operational data respectively consist of 6-bits data. Values of these data can be varied in the range of [00H] through [3FH] ('H' indicates hexadecimal).

Figure 4:
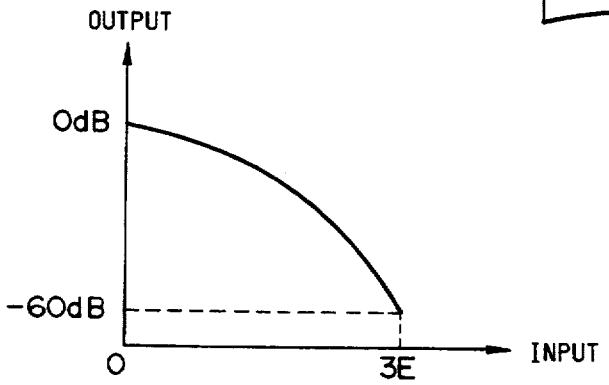
FIG. 4 shows a content of a conversion table stored in a ROM 7 provided in the preferred embodiment shown in FIG. 1.

7 designates a ROM which stores a control table including a conversion table and the like. The content of this conversion table is shown in FIG. 4 for example. The description of the conversion table will be given later on. 8 designates a tone generator which includes 4 lines of tone generating circuits, i.e., a first line tone generating circuit, a second line tone generating circuit, a third line tone generating circuit and a fourth line tone generating circuit. Each line tone generating circuit has 16 sound channels for forming musical tones. In this electronic musical instrument, 4 lines of musical tone can be generated by respective line tone generating circuits at the same time. In addition, various tone volumes can respectively be applied to respective line tone generating circuits in independence. Thus, a realistic musical tone which has desirable pan-pot can be generated. When performing by using 4 lines of tone generating circuits at the same time, the tone volumes corresponding to 4 lines are controlled by CPU 1 based on the position of joy-stick, i.e., X-directional and Y-directional joy-stick operational data as follows.

Figure 3:
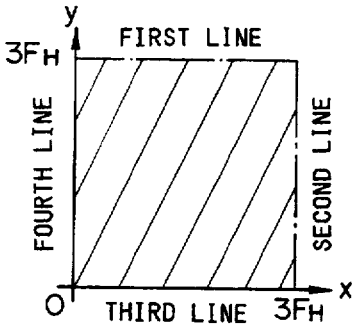
FIG. 3 shows a mean of operation applied to a joy-stick provided in the preferred embodiment shown in FIG. 1.

In x-y plane of FIG. 3, the area indicated by diagonal lines in x-y plane indicates the range in which joy-stick can be positioned. In this x-y plane, x component of a point indicates X-directional joy-stick operational data and y component of a point indicates Y-directional joy-stick operational data. The 'x' mark designates a neutral position which corresponds to the state in the case where no operation is applied to joy-stick. When the joy-stick is turned to upper side, Y-directional joy-stick operational data increases, whereby the tone volume of first line musical tone which is generated by first line tone generating circuit is enlarged in response to such movement of joy-stick. When the joy-stick is turned to right side, X-directional joy-stick operational data increases, whereby the tone volume of second line musical tone which is generated by second line tone generating circuit is enlarged in response to such movement of joy-stick. Similarly, the tone volumes of third line musical tone generated by third line tone generating circuit is enlarged by turning the joy-stick toward down side, and also the tone volume of fourth line musical tone generated by fourth line tone generating circuit is enlarged by turning the joy-stick toward left side. In this manner, the tone volumes corresponding to 4 lines musical tones are controlled in response to the operation applied to joy-stick, whereby the pan-pot of musical tone which is determined on the basis of the balance among 4 line tone volumes is controlled. The above-mentioned conversion table contents the volume data for controlling the tone volume of each line tone generating circuit in response to the joy-stick operational data, wherein the volume data is indicated by using [dB] as unit.

The musical tones generated by tone generator 8 are sent to a sound system. As a result, the generated musical tones are sounded. B designates a bus which connects the CPU1, program memory 2, work memory WM, control panel 3, performance memory 4, keyboard circuit 5, joy-stick device 6, ROM 7 and tone generator 8 together. 9 designates a timer which generates interrupt signals having constant period. The generated interrupt signals are supplied to the CPU 1. In the electronic musical instrument of this embodiment, the period of interrupt signal is determined as 10 [ms].

In this electronic musical instrument, 4 types of operation mode, i.e., a recording mode, a regeneration mode, a manual stick mode and an edit mode are provided. In the recording mode, the X-directional and Y-directional joy-stick operational data are sensed by CPU 1 every time a interval corresponding to a sampling period which can be programmed by performer elapses. When at least one of X-directional and Y-directional joy-stick operational data is changed, such data are consecutively written to the performance memory 4 as event data. In the regeneration mode, the event data are consecutively read out from the performance memory 4 and the tone volumes of the 4 lines tone generating circuits are automatically controlled in response to the read out event data. In the manual stick mode, the recording operation or reading out operation are not performed, thus, the electronic musical instrument performs as usual electronic musical instrument. In the edit mode, the performer can update the event data stored in performance memory 4.

On the control panel 3, a play switch SW1, a record switch SW2 and a edit switch SW3 are provided as shown in FIG. 2. The switch SW1 is used for command of changing to the regeneration mode. The switch SW2 is used for command of changing to the recording mode and the switch SW3 is used for command of changing to the edit mode. The control panel 3 also provides a write switch SW4 and a time mode switch SW5. The write switch SW4 is used for write command in edit mode, whereby the desirable parameter is written to desired register or performance memory 4. The time mode switch SW5 is used for the command which order that the use of current data must be changed. SW6 designates a tone shift switch. In this electronic musical instrument, the key-code of musical tone can be shifted from the key-code corresponding to depressed key on the basis of a tone shift data which is entered by the performer. The tone shift switch SW6 is used for command of writing the tone shift data. A tone color switch SW7 is used for command of changing the tone color number. In addition, #U and #D designate a up switch and a down switch which are used for command of changing the current event address which designates the current event data to be operated and stored in performance memory 4. The current address progresses toward the address of first event data by depressing the up switch #U, while the current address progresses toward the address of final event data by depressing the down switch #D. Further, the control panel 3 provides ten-keys #0 through #9, an add key #A and a subtract key #S which are used for entering numerical data such as tone color number and the like.

DISP1 designates a display. The display DISP1 provides display areas AR1 through AR5 which are implemented in LCD (Liquid Crystal Display). On the display area AR1 of display DISP1, the sampling period is displayed by using of [ms] as unit. On the display area AR2, the current event address designating the current event data to be operated is displayed, wherein the current event address is coincidence with the count which is obtained by counting events from the first event toward the current event. On the display areas AR3 and AR4, the X-directional and Y-directional joy-stick operational data are respectively displayed.

On the display area AR5, a duration data (this will be described later on) is displayed. DISP2 designates a display implemented in 7-segments LEDs (Light Emitting Diodes), on which the numerical parameters such as tone color number are displayed. LE1 through LE3 designates LED lamps which are used for displaying the operation mode and the like.

Figure 5:
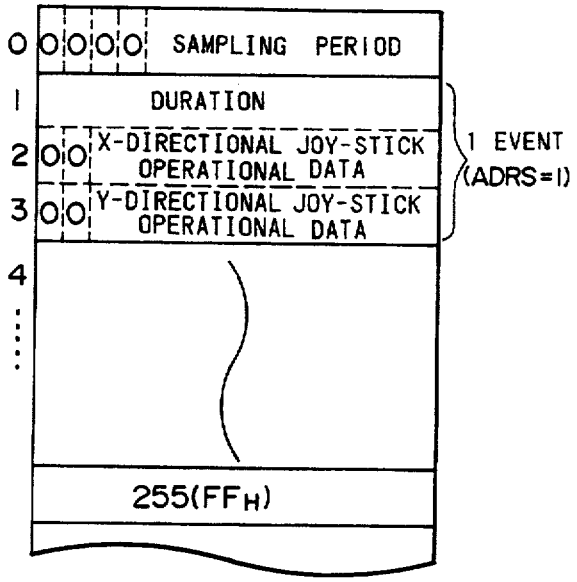
FIG. 5 shows data stored in a performance memory 4 provided in the preferred embodiment shown in FIG. 1.

Next, referring to FIG. 5, the method of storing event data in the performance memory 4 will be described. The performance memory 4 has a plurality of memory locations, wherein 1 byte data can be stored in each memory location. The memory location of performance memory 4 at address [0] is used for storing the sampling period mentioned above. More specifically, the sampling period is stored in the lower 4-bits area of this memory location. In this electronic musical instrument, the timing control is carried out on the basis of the interrupt signal which is supplied from the timer 9 by 10[ms] interval. For this reason, timing control data such as sampling period are defined by multiple of 10[ms]. The sampling period among 10[ms] through 160[ms] can be programmed by writing corresponding numerical data [0] through [15] to this memory location.

Event data are stored in the memory locations of performance memory 4 having addresses which are more than [1]. Each event data consists of 3 bytes data. For this reason, each event data occupies continued 3 memory locations of performance memory 4. Thus, above-described event addresses are assigned sequentially to each event data which respectively occupy continued 3 memory locations of performance memory 4. Accordingly, the operations for writing desirable event data and operation for reading out desirable event data are carried out by calculating the event address corresponding to desirable event data.

As the first byte of event data, a duration data or the other control command can be written to the performance memory 4. In the case where the first byte of event data is the numerical data among [1] through [253], such data means the duration data which designates the interval due to read out the next event data after reading out of the current event data. In this case, the duration data is multiplied by the sampling period, thereby obtaining the interval. In the case where the first byte of event data is [254], the data does not mean such duration time but means a loop-back command which order that the head event data must be read out as next event data. In the case where the first byte of event data is [255], such data means an end of event. As the second and third bytes of event data, the X-directional and Y-directional joy-stick operational data are respectively stored. In the recording mode, X-directional and Y-directional joy-stick operational data are supplied from the joy-stick circuit and are written to performance memory 4 like as this.

Figure 6:
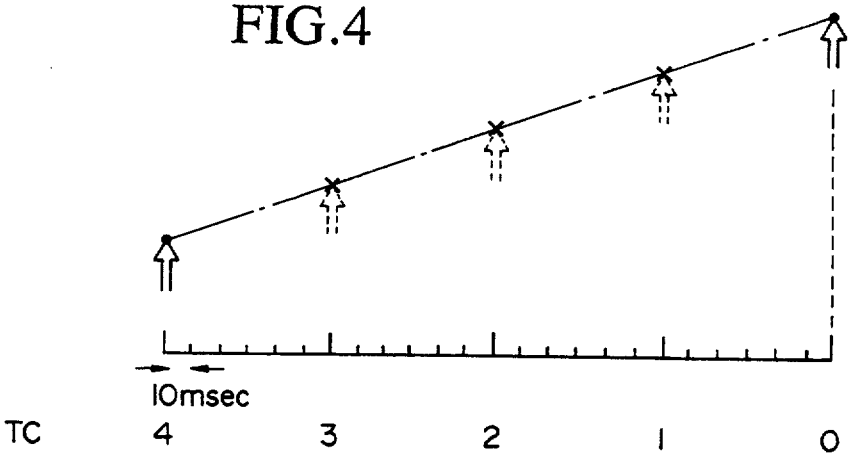
FIG. 6 shows a interpolation which is carried out on joy-stick operational data used for the preferred embodiment shown in FIG. 1.

In the regeneration mode, every time the interval designated by the current duration data elapses, the new event data is read out from performance memory 4, thus, the tone volume control is carried out on 4 lines tone generating circuits in response to new X-directional and Y-directional joy-stick operational data which are included in the new read out event data. More specifically, when controlling the tone volume on the bases of joy-stick operational data, the interpolation calculations of joy-stick operational data are carried out. Because, if changing the tone volume at the only time the interval elapses, in the case where the interval are long, the tone volume is varied like as stair way so that a sense of musical incompatibility is established. For this reason, in the midst of interval until regenerating the next event after regenerating the current event, the interpolation operation is carried out by using the current event data and next event data which will be regenerated when the current interval elapses. By this interpolation, plural pairs of the X-directional and Y-directional joy-stick operational data which respectively correspond to one or more time points between the time point corresponding to the current event and the time point corresponding to the next event are obtained. Thus, the tone volume is continuously controlled in accordance with the interpolated joy-stick operational data. For example, in the case where the sampling period is 60 [ms] and the current duration data is [4], as shown in FIG. 6, the liner-interpolation operation is carried out by using of the joy-stick operational data corresponding to continued 2 event data (these are indicated by real line arrow marks at the positions of TC=4 and 0), whereby the other joy-stick operational data corresponding to the other time points (these are indicated by dot line arrow marks) being obtained, the tone volumes are controlled in synchronization with sampling period by using obtained joy-stick operational data.

In the following, the various data areas within work memory WM will be described.

Joy-stick Operational Data Areas ADx,. ADy: The data areas ADx and ADy are used for storing X-directional and Y-directional joy-stick operational data which are supplied from A/D converter of the joy-stick device 6.

Event Address Data Area ADRS: The event address data area ADRS is used for storing the current event address which corresponds to the current event data to be operated.

Regeneration Event Address Data Area ADRSB: The regeneration event address data area ADRSB has 16 entries which respectively correspond to sound channels No. 1 through No. 16 provided in the tone generator 8. In the regeneration mode, each entry ch of this data area ADRSB, i.e., ADRSB(ch) is used for storing the event address of event data which will be applied to corresponding sound channel ch at the next: time.

Sound Channel Assign Data Area ASS: The sound channel assign data area ASS is used for storing the channel number corresponding to the sound channel to be used for musical tone generation at the current time.

Duration Data Area DUR: The duration data area DUR is used for storing the duration data included in the event data which is read out from the performance memory 4.

Address Pointer EDPNT: The address pointer EDPNT is used for storing a physical address which designates a first byte data of event data to be read out from the performance memory 4.

Numerical Data Area IN: The numerical data area IN is used for storing a numerical data which is entered by operation of ten-keys.

Key-code Data Area KCB: The key-code data area KCB has 16 entries which respectively correspond to sound channels No. 1 through No. 16. Each entry of this data area KCB, i.e., KCB(ch) is used for storing the key-code of musical tone which must be generated by corresponding sound channel ch.

Key-on Data Area KONB: The key-on data area KONB has 16 entries which respectively correspond to sound channels No. 1 through No. 16. Each entry of this data area KONB, i.e., KONB(ch) is used for storing the flag data which indicates the state of corresponding sound channel ch. When KONB(ch)='1', corresponding sound channel ch is used for musical tone generation, whereas when KONB(ch)='0' corresponding sound channel ch is not busy.

Line Designating Data Area LEDFLG: The line designating data area LEDFLG is used for storing the line number of musical tone, wherein the line number is determined by direction along which the joy-stick is tuned.

Mode Designating Data Area MD: The mode designating data area MD stores the data which designates the operation mode as follows.

MD=1→Manual stick mode
MD=2→Regeneration mode
MD=3→Recording mode
MD=4→Edit mode Ten-key Operation Designating Flags MD10, MDTM: In the other modes except for edit mode, the content of flag MD10 determines the use of the numerical data which is entered by ten-keys. In the case where MD10='0', the entered numerical data is regarded as tone color number. In the case where MD10='1', the entered numerical data is regarded as tone shift data. In edit mode, the content of flag MDTM determines the use of the entered numerical data. In the case where MDTM='0', the entered data is regarded as duration data. In the case where MDTM='1', the entered data is regarded as sampling period.

Release Channel Number Data Area OFF: The release channel number data area OFF is used for storing the channel number corresponding to the sound channel which must be stop the musical tone generation.

Tone Shift Data Area SFT: The tone shift data area SFT has 4 entries which respectively correspond to 4 lines of tone generating circuits. Each entry of this data area SFT, i.e., SFT(i) stores a numerical data among [−24] through [24] as tone shift data to be applied to corresponding line tone generating circuit i.

Sampling Period Data Area SMP: In the sampling period data area SMP, a numerical data among [1] through [16] can be stored, thereby designating the sampling period, wherein the stored numerical data [1] corresponds to 10[ms].

Sampling Period Count Data Area SMPCNT: The sampling period count data area SMPCNT is used for detecting the changing of sampling period. More specifically, a numerical data corresponding to the sampling period is set to this data area SMPCNT, after which the content of this data area is decremented by one every time a interrupt signal is generated from the timer 9. By detecting that the content of SMPCNT becomes [0], the changing of sampling period is detected.

Channel Timer Data Area TCB: The channel timer data area TCB has 16 entries which respectively correspond to the sound channels No. 1 through No. 16 of tone generator 8. Each entry of this data area TCB, i.e., TCB(ch) stores a data indicating a remaining time which is remained until the next event will be regenerated and applied to corresponding sound cannel ch.

Time Count Data Area TC: The time count data area TC is used for counting interrupt signals in order to count the lapsed time corresponding to the duration data currently set.

Time Count Data Area For Respective Sound Channels TS: This data area TS has 16 entries which respectively correspond to sound channels No. 1 through No. 16. Each entry of this data area TS, i.e., TS(ch) is used for storing the duration data of current event data which is applied to corresponding sound channel ch.

Duration Data Saving Area TDUR: In the duration data saving area TDUR, the content of duration data area DUR is saved.

Sampling Period Data Saving Area TSMP: In the sampling period data saving area TSMP, the content of sampling period data area TSMP is saved.

Tone Color Number Data Area TONE: The tone color number data area has 4 entries which respectively correspond to 4 lines of tone generating circuits. Each entry of this data area TONE, i.e., TONE(i) stores the tone color number among [0] through [99] which designates the tone color applied to corresponding line tone generating circuit i.

Regenerated Operational Data Areas VCx, VCy: In these regenerated operational data areas VCx and VCy, X-directional and Y-directional joy-stick operational data are respectively set, thereby carrying out the tone volume control for 4 line musical tones.

Available Operational Data Areas VOx, VOy: These available operational data areas VOx and VOy respectively have 16 entries which respectively correspond to sound channels No. 1 through No. 16. Each entries of these data areas VOx and VOy, i.e., VOx(ch) and VOy(ch) respectively store the X-directional and Y-directional joy-stick operational data. The contents of VOx(ch) and VOy(ch) are applied to corresponding sound channel ch.

Next Regeneration Operational Data Areas VNx, VNy: The next regenerating operational data areas VNx and VNy respectively have 16 entries which respectively correspond to sound channel No. 1 through No. 16. Each entries of these data areas VNx and VNy, i.e., VNx(ch) and VNy(ch) store the X-directional and Y-directional operational data which must be applied to corresponding sound channel ch of 4 lines of tone generating circuits at the next time.

Volume Control Data Areas $V_1$ through $V_4$: In these data areas $V_1$ through $V_4$, the data respectively used for the tone volume control of 4 line musical tones are stored.

In the following, the operation of the electronic musical instrument of the present embodiment will be described referring to the flow charts shown in FIGS. 7 through 24.

Figure 7:
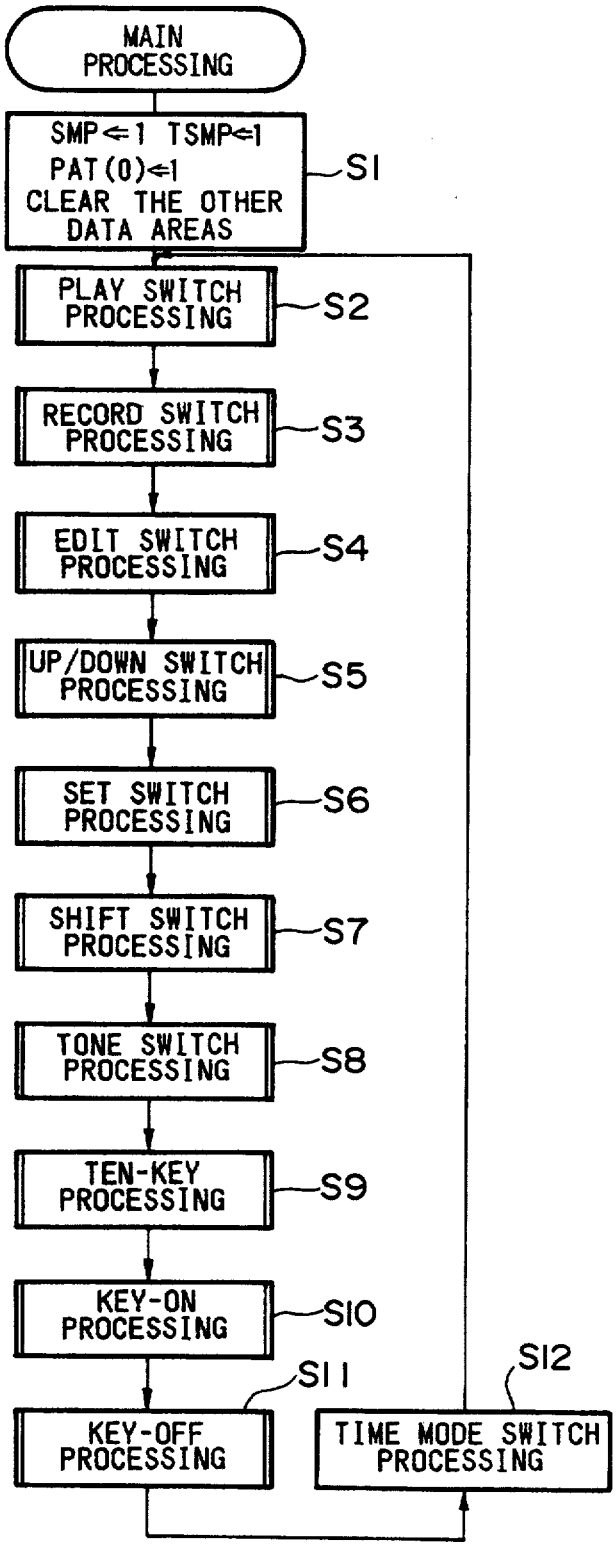
FIGS. 7 through 24 are flow charts respectively showing operation of the preferred embodiment shown in FIG. 1.

After the power switch is turned on, thus supplying electrical power from the power supply to respective components in the electronic musical instrument of the present embodiment, CPU 1 proceeds to execute the main routine of a control program stored in program memory 2 shown in the flow chart of FIG. 7. Thus, immediately after power is supplied, the above mentioned control program is read into CPU 1 from program memory 2 via bus B, after which the execution of the main routine of the control program begins with step S1. In the step S1, initial processing is carried out, wherein various data areas in work memory WM are initialized. More specifically, the initial value [1] is written to both the sampling period data area SMP and sampling period data saving area TSMP. In addition, the initial value [1] is written to the memory location of performance memory 4 at address [0], wherein the value [1] designates 20[ms] as the sampling period. Further, the other data areas are all cleared.

Figure 8:
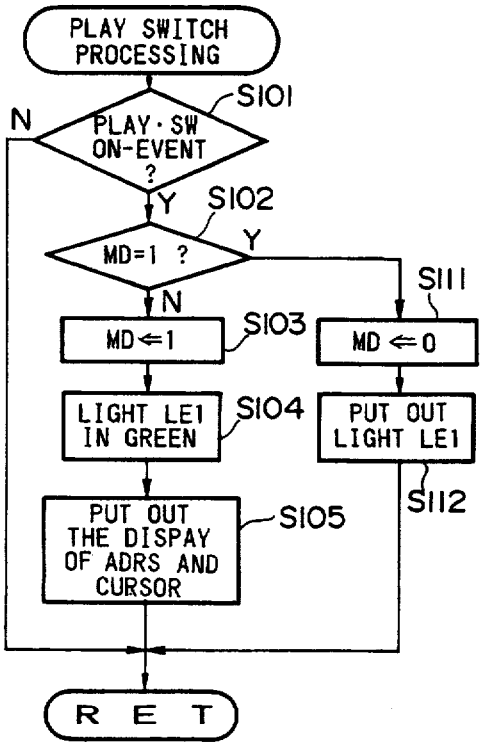
Figure 9:
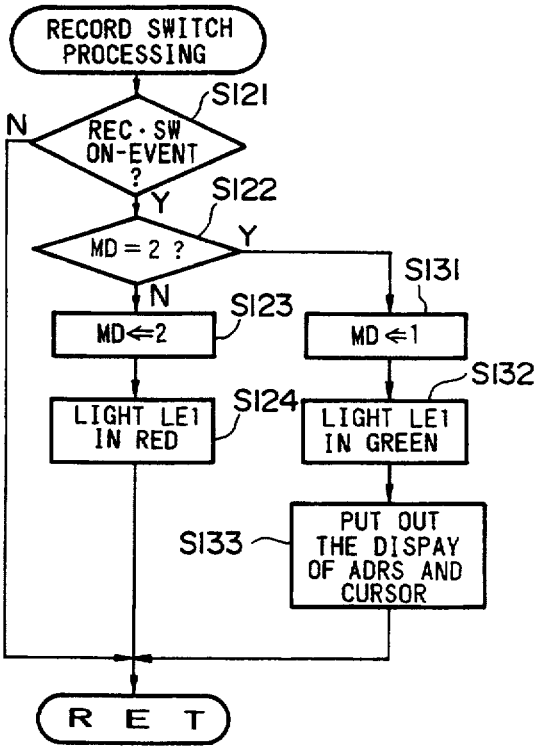
Figure 12:
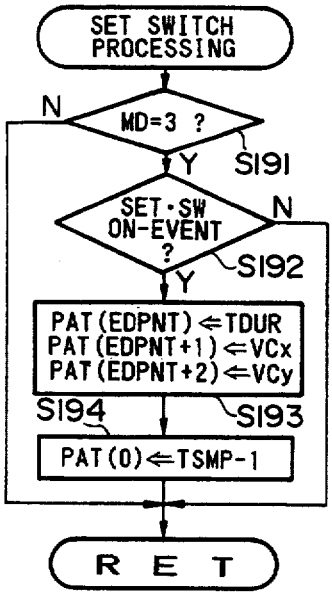

After completion of step S1, the routine proceeds to step S2, wherein a play switch processing routine shown in the flow chart of FIG. 8 is executed. When proceeding to step S101 of play switch processing routine, a judgement is made as to whether the switch SW1 has been depressed and on-event of switch SW1 is detected or not. When the result of this Judgement is [No], control returns to main routine, after which the routine proceeds to step S3 of the main routine, whereas when the result of this Judgement is [YES], control proceeds to steps after step S101 of play switch processing routine. After completion of step S2, the operations of steps S3 through S12 are consecutively executed and the routine back to step S2 again. In these steps S3 through S12, plural routines corresponding to respective operational elements are executed like as step S2 mentioned above. In the first step of executed routine, a judgement is made as to whether corresponding operational element has been operated or not. When no operation has been applied to corresponding operational element, the result of this judgement is [NO], whereby control returns to main routine, whereas when the result of this Judgement is [YES], the routine proceeds to steps after the first step of executed routine. In this manner, steps S2 through S12 are repeatedly executed.

<Mode setting>

When the performer depress the play switch SW1, the on-event corresponding to switch SW1 is detected by CPU 1. Thus, when the routine proceeds to step S101 of play switch processing routine shown in flow chart of FIG. 8 via step S2 of the main routine, a Judgement being made as to whether an on-event of the play switch SW1 is detected or not, in this case, the result of this judgement is [YES], whereby the routine proceeds to step S102. In step S102, a judgement is made as to whether the content of mode designating data area MD is a value of [1] or not. When the result of this judgement is [NO], the routine proceeds to step S103, wherein a value of [1] corresponding to regeneration mode is set to the mode designating data area MD. After completion of step S103, the routine proceeds to S104, wherein the CPU1 lights the LED LE1 in green. Next, the routine proceeds to step S105, wherein the displaying of display area AR2 in display DISP1 is put out and an arrow mark directed to left is displayed on right side area of display area AR1. After completion of step S105, control returns to main routine.

On the other hand, in the case where the result of judgement in step S102 is [YES], i.e., the operation mode is regeneration mode, the routine proceeds to step S111, wherein a value of [0] corresponding to manual stick mode is set to the mode designating data area MD. Next, the routine proceeds to step S112, wherein the LED LE1 is put out. After completion of step S112, control returns to the main routine.

In this manner, when the operation mode is not regeneration mode, by depressing switch SW1, the operation mode is changed to regeneration mode and the LED LE1 is lighted in green, whereas when the operation mode is regeneration mode, by depressing switch SW1, the operation mode is changed to manual stick mode from regeneration mode and the LED LE1 is put out.

When the performer depresses the record switch SW1, the on-event of record switch SW2 is detected by CPU 1. Thus, when the routine proceeds to step S121 of a record switch processing routine shown in flow chart of FIG. 9 via step S3 of main routine, a Judgement being made as to whether an on-event of the record switch SW2 is detected, in this case, the result of this Judgement is [YES], whereby the routine proceeds to step S122. In step S122, a Judgement is made as to whether the content of mode designating data area MD is [2] or not. When the result of this Judgement is [NO], the routine proceeds to step S123, wherein a value of [2] corresponding to recording mode is set to the mode designating data area MD. After completion of step S123, the routine proceeds to S124, wherein the CPU1 lights the LED LE1 in red. After completion of step S124, control returns to main routine.

On the other hand, in the case where the result of Judgement in step S122 is [YES], i.e., the current operation mode is recording mode, the routine proceeds to step S131, wherein a value of [1] corresponding to regeneration mode is set to the mode designating data area MD. Next, the routine proceeds to step S132, wherein CPU 1 lights the LED LE1 in green, after which the routine proceeds to step S133, wherein CPU 1 puts out the displaying of the display area AR2 in display DISP1 and also puts out the arrow mark indicated in right side of display area AR1. After completion of step S133, control returns to main routine.

In this manner, when the operation mode is not recording mode, by the operation of depressing switch SW2, the operation mode is changed to recording mode and the LED LE1 is lighted in red, whereas when the operation mode is recording mode, by the operation of depressing switch SW2, the operation mode is changed to regeneration mode from recording mode and the LED LE1 is lighted in green.

On the other hand, when the performer depresses the switch SW3, the on-event of switch SW3 is detected by the CPU 1. Consequently, when the routine proceeds to step S141 of an edit switch processing routine shown in flow chart of FIG. 10 via step S4 of main routine, a judgement being made as to whether an on-event of switch SW3 is detected or not, the result of this judgement is [YES], whereby the routine proceeds to step S142. In step S142, a judgement is made as to whether the content of mode designating data area MD is a value of [3] or not. When the result of this judgement is [YES], i.e., the current operation mode is edit mode. The routine proceeds to step S143, wherein a value of [1] corresponding to regeneration mode is set to the mode designating data area MD. After completion of step S143, the routine proceeds to S144, wherein CPU1 lights the LED LE1 in green. Next, the routine proceeds to step S145, wherein CPU 1 puts out the displaying of display area AR2 on display DISP1 and also puts out the arrow mark in right side of display area AR1. After completion of step S145, control returns to main routine.

On the other hand, in the case where the result of judgement in step S142 is [NO], the routine proceeds to step S161, wherein a value of [3] corresponding to edit mode is set to the mode designating data area MD. Next, the routine proceeds to step S162, wherein a value of [1] is set to the address pointer EDPNT. After completion of step S162, the routine proceeds to step S163. In this step S163, a data PAT(O) stored in the memory location of performance memory 4 at address [0] is read out, after which the read out data PAT(O) is added [1]. The result of this addition is set to sampling period data area SMP. Additionally, the duration data of first event is read out from the memory location of performance memory 4 at the address which is designated by address pointer EDPNT (in this case EDPNT=[1]), after which the read out duration data is set to the duration data area DUR. Further, a X-directional joy-stick operational data is read out from the memory location of performance memory 4 at the address (EDPNT+1) (in this case, EDPNT+1=[2]), after which the read out X-directional joy-stick operational data is set to the regenerated operational data area VCx. Further more, a Y-directional joy-stick operational data is read out from the memory location of performance memory 4 at the address (EDPNT+3), after which the read out Y-directional joy-stick operational data is set to the regenerated operational data area VCy. After completion of step S163, the routine proceeds to step S164, the content of sampling period data area SMP is set to data area TSMP, and also the content of duration data area DUR is set to data area TDUR. Next, the routine proceeds to step S165, wherein the calculation of (EDPNT+2)/3 is carried out, whereby the event address corresponding to event data which is designated by address pointer EDPNT is obtained, after which the obtained event address is set to event address data area ADRS. Next, the routine proceeds to step S166, wherein the content of data area TSMP is multiplied by [10], after which the result of this multiplication TSMP*10 is displayed on display area AR1 as current sampling period, and also the content of event address data area ADRS is displayed on display area AR2 as current event address. Next, the routine proceeds to step S167, wherein the LED LE1 is lighted in red. After completion of step S167, control returns to main routine.

In this manner, when the operation mode is not edit mode, by the operation of depressing the edit switch SW3, the operation mode being changed to edit mode, the LED LE1 is lighted in red, whereas when the operation mode is edit mode, by the operation of depressing the edit switch SW3, the operation mode being changed to regeneration mode, the LED LE1 is lighted in green.

<Manual stick mode>

In the following, the operation of manual stick mode mode will be described. When the performer depresses a key provided on key-board, a key-on event corresponding to depressed key is outputted from the keyboard circuit 5 and inputted to CPU 1. In this case, when the routine proceeds to step S251 of a key-on processing routine shown in flow chart of FIG. 16 via step S10 of main routine, a judgement being made as to whether a key-on event is detected or not, in this case, the result of this judgement is [YES], whereby the routine proceeds to step S252. In step S252, available sound channels are found out from 16 sound channels of tone generator 8, after which the number corresponding to one of the available sound channels is set to data area ASS. Next, the routine proceeds to step S253, wherein a value of '1' is set to KONB(ASS) and also the key-code of inputted key-on event is set to KCB(ASS). Next, the routine proceeds to step S254, wherein 4 key-codes KCB(ASS)+SFT(1), KCB(ASS)+SFT(2), KCB(ASS)+SFT(3) and KCB(ASS)+SFT(4) are respectively supplied to the first line through the fourth line of tone generating circuits, wherein sound channel of 4 lines of tone generating circuits to be sound is designated by ASS. In the case where no operation has been applied to the switch SW6 after the initialization mentioned above, values of [0] are all set to respective entries of tone shift data area, i.e., SFT(1) through SFT(4) so that the same key-code KCB(ASS) is set to 4 lines of tone generating circuits. As a result, in 4 lines of tone generating circuits, musical tones which having the same key-code KCB(ASS) are generated. Additionally, a data stored in the sampling period data area SMP is set to data area SMPCNT. The operation for writing the tone shift data to data area SFT(1) through SFT(4) will be described later on.

Next, the routine proceeds to step S255, wherein a judgement is made as to whether the content of mode designating data area MD is [1] or not. In this case, the result of this judgement is [NO], whereby the routine proceeds to step S256, wherein a judgement is made as to whether the content of mode designating data area MD is [2] or not. The result of this judgement is also [NO], whereby control returns to main routine.

Figure 24:
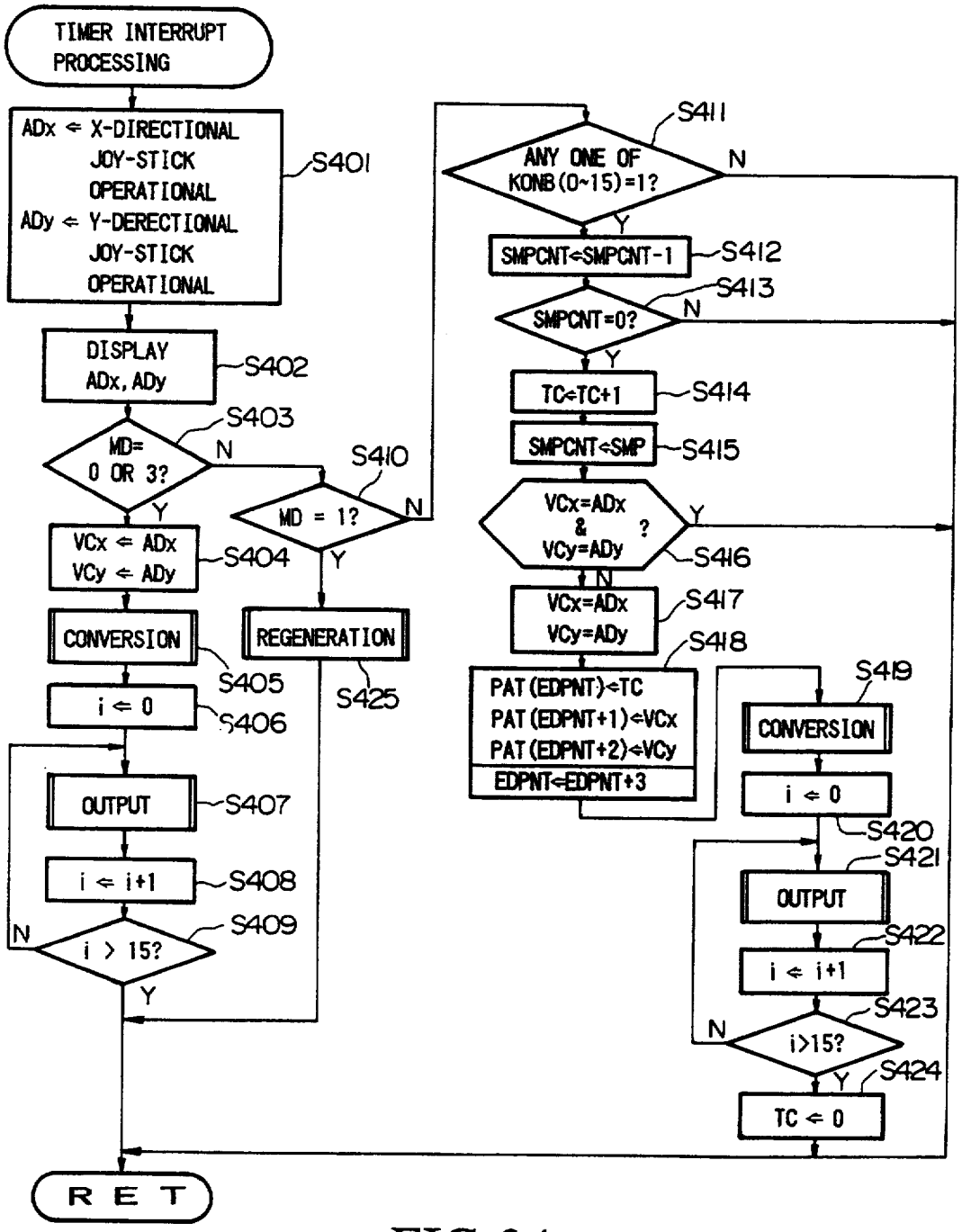

On the other hand, every time an interrupt signal is supplied to CPU 1 from timer 9, whereby CPU 1 halts the routine currently under execution, and commences execution of a timer interrupt routine shown in flow chart of FIG. 24. In step S401, X-directional and Y-directional joy-stick operational data outputted from A/D converter of the joy-stick device 6 are respectively stored in operational data areas ADx and ADy. Next, the routine proceeds to step S402, wherein the content of these data areas ADx and ADy are displayed on the display areas AR3 and AR4 of the display DISP1. Next, the routine proceeds to step S403, wherein a judgement is made as to whether the content of mode designating data area MD is any of [0] and [3] or not. In this case, the result of this judgement is [YES], whereby the routine proceeds to step S404, wherein the content of data area ADx and ADy are respectively stored in regenerated operational data areas VCx and VCy. Next, the routine proceeds to step S405, wherein CPU 1 proceeds to execute a conversion routine shown in flow chart of FIG. 20.

In step S301, a judgement is made as to whether the content of regenerated operational data area VCx is more than [20H] or not. When the result of this judgement is [YES], the subtraction of VCx−[1] is calculated, after which the result of this subtraction is stored in the data area Vx (step S302), whereas when the result of this judgement is [NO], the content of data area VCx is directly stored in the data area Vx (step S303). After completion of step S302 or step S303, the routine proceeds to step S304, wherein a judgement is made as to whether the content of regenerated operational data area VCy is more than [20H] or not. When the result of this judgement is [YES], the subtraction of VCy−[1] is calculated, after which the result of this subtraction is stored in the data area Vy (step S305), whereas when the result of this judgement is [NO], the content of data area VCy is directly stored in the data area Vy (step S306).

After completion of step S305 or step S306, the CPU 1 executes the operations of steps S307 through S310, whereby the calculations according to following equations (1) through (4) are carried out, after which the results of these calculations are respectively stored in the data areas VJ (J=1 through 4).

$$V_1=(3EH-Vy)+ABS(Vy-1FH) \quad (1)$$

$$V_2=(3EH-Vx)+ABS(Vy-1FH) \quad (2)$$

$$V_3=Vy+ABS(Vx-1FH) \quad (3)$$

$$V_4=Vx+ABS(Vy-1FH) \quad (4)$$

In the above equations (1) through (4), ABS(X) means the absolute value of X. Referring to FIGS. 25(*a*) through 25(*d*), the means of these data $V_1$ through $V_4$ will be described. In these drawings, the points P(Vx, Vy) corresponds to the current position of joy-stick. When no operation is applied to joy-stick, Vx and Vy are both [1FH]. In addition, the point PA(1FH, 3EH) is corresponds to the joy-stick operational position at which the tone volume of first line tone generating circuit is enlarged in maximum; the point PB(3EH, 1FH) is corresponds to the joy-stick operational position at which the tone volume of second line tone generating circuit is enlarged in maximum; the point PC(1FH, 00H) is corresponds to the joy-stick operational position at which the tone volume of third line tone generating circuit is enlarged in maximum and the point PD(00H, 1FH) is corresponds to the joy-stick operational position at which the tone volume of fourth line tone generating circuit is enlarged in maximum. By using lengths lax, lay, lbx, lby, lcx, lcy, ldx and ldy shown indicated in FIGS. 25(*a*) through 25(*d*), above calculated $V_1$ through $V_4$ are respectively rewritten as following equations (5) through (8).

$$V_1 = lax + lay \quad (5)$$

$$V_2 = lbx + lby \quad (6)$$

$$V_3 = lcx + lcy \quad (7)$$

$$V_4 = ldx + ldy \quad (8)$$

Herein, lax corresponds to X-directional dlsplacement between the point P and point PA; lay corresponds to Y-directional displacement between the point P and point PA. Thus, $V_1$ can be regarded as a parameter which indicates the displacement between the point P and point PA. Similarly, the other data $V_2$ through $V_4$ can be regarded as parameters which respectively indicate the distances between the point P and point PB, between the point P and point PC and between the point P and point PD. These obtained data $V_1$ through $V_4$ are respectively used for controlling the tone volumes of the first through fourth line musical tones (this operation will be described later on).

Next, the routine proceeds to step S311, wherein a judgement is made as to whether $V_1$ through $V_4$ are within [3EH] or not. When any one of the content of $V_1$ through $V_4$exceeds [3EH], the content of such data area is set to [3EH]. Next, the routine proceeds to step S312, wherein a judgement is made as to whether any one of $V_1$ through $V_4$ is less than [10H], i.e., the joy-stick has been turned-down toward the point PA, PB, PC or PD strongly and rightly or not. When the result of this judgement is [NO], the routine proceeds to step S313, wherein a value of [0] is set to data area LEDFLG. Next, the routine proceeds to step S314, wherein the LEDs LE2 and LE3 are put out and the displaying of display DISP2 is put out. And then, the routine proceeds to step S319.

On the other hand, when the result of judgement in step S312 is [YES], the routine proceeds to step S315, wherein the line number J which satisfies the condition of that Vj is less than [10H] is stored in data area LEDFLG. Next, the routine proceeds to step S316, wherein a judgement is made as to whether the content of MD10 is [0] or not. When the result of this judgement is [YES], the routine proceeds to step S317, wherein lighting the LED LE3, the tone color number currently stored in TONE(J) corresponding to the $j^{th}$ line musical tone is displayed on the display DISP2. Next, the routine proceeds to step S319, wherein the data stored in data areas $V_1$ through $V_4$ are respectively converted to the volume data based on a conversion table which is stored in ROM 7 and shown in FIG. 4. And then, the converted volume data are respectively stored in data area $V_1$ through $V_4$ again. As shown in FIG. 4, when VJ is a small value, Vj is converted to a large value, whereas when Vj is a large value. Vj is converted to a small value. In this manner, the CPU 1 obtains the volume data $V_1$ through $V_4$ which intense the tone volume of line corresponding to the direction along which the joy-stick is turned strongly and rightly. After completion of step S319, control returns to the timer interrupt routine shown in flow chart of FIG. 24.

Figure 21:
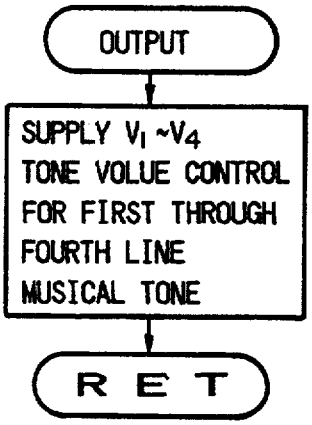

When control returns to the timer interrupt routine, the routine proceeds to step S406, wherein a parameter i is set of [0]. Next, the routine proceeds to step S407, wherein an output processing routine shown in flow chart of FIG. 21 is executed, whereby the volume data $V_1$ through $V_4$ are respectively supplied to first line through forth line tone generating circuits in the tone generator 8 as tone volume control data for $i^{th}$ sound channel. As a result, the tone volume control for the $i^{th}$ sound channel is carried out on each tone generating circuit j on the basis of corresponding volume data Vj. Next, the routine proceeds to step S408, wherein the parameter i is incremented by one. Next in step S409, a judgement is made as to whether $i > 15$ is true or not. When the result of this judgement is [NO], the routine returns to step S407. Thus, while i is less equal than 15, the operations of steps S407 and S408 is repeatedly executed so that the tone volume control for the $0^{th}$ through $15^{th}$ sound channels are sequentially executed. After completion of these volume control, the result of judgement in step S409 becomes [YES], whereby control returns to main routine. Thereafter, when the timer interrupt routine is executed, the above described processing is executed again, thereby carrying out the tone volume control for the first through fourth line musical tones.

When the performer releases the key which has been depressed till then, the key-off event of released key is detected by CPU 1. As a result, when the routine has proceeded to step S271 of a key-off processing routine shown in flow chart of FIG. 17 via step S11 of main routine, wherein a judgement being made as to whether any key-off event is detected, in this case, the result of this judgement is [Yes], whereby the routine proceeds to step S272. In step S272, the sound channel ch generating the musical tone having a key-code which is coincidence with the key-code of detected key-off event is searched, after which the searched sound channel number ch is stored in data area OFF. Next, the routine proceeds to step S274, wherein the key-on data area KONB at the entry OFF, i.e., KONB(OFF) is cleared. Next, in step S274, the forcing dump operation is carried out on the 4 lines of the tone generating circuits provided in tone generator 8, wherein the sound channel to be forced dump in each tone generating circuit is designated by OFF. Next, the routine proceeds to step S275, wherein a judgement is made as to whether the content of MD is [2] or not. In this case, the result of this judgement is [NO], whereby the routine proceeds to step S276, wherein a judgement is made as to whether the content of MD is [1] or not. The result of this judgement is also [NO], whereby control returns to main routine.

In the case where setting a tone color, the performer depresses the tone color switch SW7. As a result, the switch-on event corresponding to tone color switch SW7 is detected by CPU 1. In this case, when the routine has proceeded to step S211 of a tone switch processing routine shown in flow chart of FIG. 14 via step S8 of main routine, a judgement being made as to whether tone color switch has been depressed or not, the result of this judgement is [YES], whereby the routine proceeds to step S212. In step S212, a value of '0' is set to flag MD10. Next, the routine proceeds to step S213, wherein the content of line designating data area LEDFLG is greater than [0] or not. In the case where the performer has turned the joy-stick strongly and rightly toward one of points PA, PB, PC and PD which respectively correspond to the first through fourth line musical tones, when the routine has proceeded to execute the conversion routine shown in flow chart of FIG. 20 via timer interrupt routine and proceeded to step S315, wherein the line number corresponding to the direction along which the joy-stick has be turned-down is set to the line designating data area LEDFLG (above described step S315). Thus, in this case, the result of judgement in step S213 is [YES], whereby the routine proceeds to step S214. In step S214, CPU 1 puts out the LED LE2, and displays the tone color number currently stored in tone color number data area TONE at entry LEDFLG on the display DISP2 as the tone color number designated by operation of joy-stick. And then, control returns to main routine. On the other hand, when the result of judgement is [NO], control directly returns to main routine without executing the other operation. In this manner, the line number of tone generating circuit to be set tone color is determined.

After completion of above operation, the performer enters desired tone color number by operating ten-keys #0 through #9. As a result, key-on events corresponding to depressed keys are detected by the CPU 1. Thus, when the routine has proceeded to step S231 of a ten-key processing routine shown In flow chart of FIG. 15 via step S9 of main routine, wherein a judgement being made as to whether any ten-key on-event has been detected or not, the result of this judgement is [YES], whereby the routine proceeds to step S232. In step S232, a judgement is made as to whether the content of LEDFLG is greater than [0]. When the joy-stick is turned-down strongly and rightly to determine the line of tone generating circuit, the result of judgement in step S232 is [YES], whereby the routine proceeds to step S233. in step S233, a judgement is made as to whether a depressed key is one of ten-keys #0 through #9 or one of the add key #A and subtract key #s. In this case, depressed is one of the ten-keys so that the routine proceeds to step S234, wherein the numerical data entered by ten-keys is stored in the numerical data area IN, after which the stored data of data area IN is displayed on display DISP2. Next, in step S235, a judgement is made as to whether MD10='1' or not. In this case, the result of this judgement is [NO], whereby the routine proceeds to step S237, wherein the numerical data stored in data area IN is stored the tone color number data area TONE at entry LEDFLG, i.e., TONE(LEDFLG). Next, in step S238, the tone color parameters corresponding to tone color number TONE(LEDFLG) are sent to corresponding tone generating circuit of having a line number which is designated by LEDFLG. On the other hand, when the result of judgement in step S232 is [NO], control returns to main routine via step S243. In this manner, based on operation applied to joy-stick, being determined the line number of tone generating circuit, the tone color parameters corresponding to tone color number entered by operating ten-keys are set to the tone generating circuit having the determined line number.

In the electronic musical instrument of present embodiment, tone color number can be set by operation of ten-keys, and also can be set by incrementing or decrementing the tone color number which has been already set. In order to carry out such operation, the performer depresses the add key #A or subtract key #S after turning joy-stick toward one of the points PA, PB, PC and PD. As a result, when the ten-key processing routine is proceeded to executed, the routine proceeds to step S239 via step S233. In step S239, a judgement is made as to whether the content of MD10 is '1' or not. In this case, the result of this judgement is [NO], whereby the routine proceeds to step S240. In step S240, when depressed key is the add key #A, the content of TONE(LEDFLG) is incremented by one, whereas when depressed key is the subtract key #S, the content of TONE(LEDFLG) is decremented by one. After incrementing or decrementing, the content of TONE(-LEDFLG) is displayed on display DISP2. Next in step S238, based on the tone color number stored in tone color number data area TONE at entry LEDFLG, the tone color parameters are set to the tone generating circuit having the line number LEDFLG.

When setting a tone shift data, the performer depress the shift switch SW6. As a result, the key-on event corresponding to switch SW6 is detected by CPU 1. In this case, when the routine has proceeded to step S201 of a shift switch processing routine shown in flow chart of FIG. 13 via step S7 of main routine, a judgement being made as to whether the shift switch SW7 has been depressed or not, the result of this judgement is [YES], whereby the routine proceeds to step, S202, therein setting a value of '1' to mode designating flag: MD10. Next, the routine proceeds to step S203, wherein a judgement is made as to whether the content of LEDFLG is greater than [0] or not.

In the case where the joy-stick has been turned strongly and rightly so as to determine line number, the line number of tone generating circuit has been determined, after which the determined the number has been stored in line number designating data area LEDFLG. Thus, in this case, when the routine proceeds to step S203, the result of judgement in step S203 is [YES], whereby the routine proceeds to step S204. In step S204, CPU 1 puts out the LED LE3, and displays the content of tone shift data area SFT at entry LEDFLG, i.e., SFT(LEDFLG) on the display DISP2. After completion of step S204, control returns to main routine. On the other hand, in the case where the result of judgement in step S203 is [NO], the routine directly returns to main routine without executing the other processing.

After above operation, the performer depresses ten-keys #0 through #9, add key #A or subtract key #S. In this case, when the ten-key processing routine is executed via step S9 of main routine, the routine proceeds to step S233 via steps S231 and S232, wherein a branch decision is made. Thus, when depressed key is any one of ten-keys #0 through #9, the routine branches to step S234, whereas when depressed key is any one of add key #A or subtract key #S, the routine branches to step S241 via step S239. In the case where depressed key is any one of ten-keys and the routine proceeds to step S234, therein the numerical data entered by ten-key operation is stored in numerical data area IN. After which, a judgement being made as to whether stored data in data area IN is within the regular range of [−24] through [+24] in which the tone shift data can be set. When the result of this judgement is [NO], whereby stored data in data area IN is corrected to the numerical data within regular range. After above operation, the content of data area IN is displayed on the display DISP2. Next, the routine proceeds to step S236 via step S235, wherein the content of IN is stored in the tone shift data area SFT at entry LEDFLG. i.e., SFT(LEDFLG). On the other hand, in the case where depressed key is add key #A or subtract key #S and the routine proceeds to step S241. In step S241, when depressed key is add key #A, the absolute value of SFT(LEDFLG) is computed, after which the computed absolute value is stored in SFT(LEDFLG), whereas when depressed key is subtract key #S, the absolute value of SFT(LEDFLG) being computed, the computed absolute value is converted to minus data which has the same absolute value, after which the converted minus data is stored in SFT(LEDFLG). After completion of step S241, control returns to main routine via steps S242 and S238.

<Recording mode>

During recording mode (MD=[2]), when the timer interrupt routine (FIG. 24) is executed, the routine proceeds to step S411 via steps S401, S402, S403 and S410, wherein a Judgement is made as to whether any entry i (i=0 through 15) of key-on data area KONB is '0' or not. When the result of this judgement is [NO], i.e., no sound channel generates musical tone, control returns to main routine.

When the performer depresses a key of key-board, the key-on event corresponding to depressed key is detected by CPU 1. In this case, the operations of steps S251 through S254 in the key-on processing routine are carried out, whereby musical tone corresponding to depressed key is generated, and also the content of sampling period data area SMP is written to data area SMPCNT, after which the routine proceeds to step S257 via steps S255 and S256. In step S257, a judgement is made as to whether at least one of the any other keys except for depressed key is depressed or not. When the result of this judgement is [YES], control returns to main routine, whereas when the result of this judgement is [NO], the routine proceeds to step S258, wherein a value of [1] is set to address pointer EDPNT, and a value of [0] is set to tone color number data area TC, after which the routine returns to main routine.

When the timer interrupt routine is executed after above operations has been completed, the routine proceeds to step S411 via steps S401 through S403 and S410, wherein the result of judgement in step S411 is [YES], whereby the routine proceeds to step S412, wherein the content of sampling period count data area SMPCNT is decremented by one. Next in step S413, a judgement is made as to whether the content of data area SMPCNT has reached [0] or not. When the result of this judgement is [NO], control returns to main routine.

When a interval of 10[ms] elapses after the timer interrupt routine has been executed as described above, the timer interrupt routine is executed again. In this case, the routine proceeds to step S412, therein the content of SMPCNT is decremented by one, after which the routine proceeds to step S414, therein a judgement is made as to whether the content of data area SMPCNT has reached [0] or not. When the result of this judgement is [YES], control returns to main routine. Thereafter, the same processing as described above are repeatedly executed by the interval time of 10[ms] while SMPCNT>[0].

When the content of sampling period count data area SMPCNT reaches [0], the result of judgement in step S413 becomes [YES], whereby the routine proceeds to step S414, wherein the content of time count data area TC is incremented by one. Next in step S415, the content of SMP is set to the data area SMPCNT. Thus, every time a interval designated by SMP elapses, the result of judgement in step S413 becomes [YES], thereby executing the processing on and after step S414.

When the routine proceeds to step S416, therein a judgement is made as to whether the contents of joy-stick operational data areas ADx and ADy are respectively coincidence with the contents of regenerated operational data areas VCx and VCy, i.e., the position of joy-stick is not changed or not. When the result of this judgement is [YES], control returns to main routine. Thereafter, the timer interrupt routine is repeatedly executed every time the interval of 10[ms] elapses, wherein when the condition of SMPCNT=[0] is satisfied, thereby executing the judgement step S416. When the performer has moved the joy-stick and at least any one of contents of joy-stick operational data areas ADx and ADy are changed, the result of judgement in step S416 becomes [NO], whereby the routine proceeds to step S417, wherein new joy-stick operational data stored in data areas ADx and ADy are respectively stored in regenerated operational data areas VCx and VCy. Herein, at this time, the time count data area TC stores the sampling period count which is obtained by counting sampling periods which occur between the time when the result of judgement in step S416 had become [YES] at last time and the time when the result of judgement in step S416 becomes [YES] at this time. Next, in step S418, the content of TC is written to the memory location of performance memory 4 at the address EDPNT (in this case EDPNT=[1]) as duration data of event data. In addition, the contents of data areas VCx and VCy are respectively written to the memory locations of performance memory 4 at addresses (EDPNT+1) and (EDPNT+2) as joy-stick operational data. After completion of above described writing operation, the content of address pointer EDPNT is incremented by [3]. As a result, in this case, the content of address pointer becomes [4] which designates the address designating the duration data of second event.

Next, the routine proceeds to step S419, wherein the conversion routine is executed, whereby the volume data are calculated on the basis of the contents of VCx and VCy, after which the calculated volume data are stored in the data areas $V_1$ through $V_4$. Next, in step S420, the parameter i is set to [0]. Next, the output processing routine being executed (step S421), whereby the tone volume at $i^{th}$ sound channel of respective lines tone generating circuits provided in tone generator 8 are controlled in response to the volume data $V_1$ through $V_4$, after which the parameter i is incremented by one (step S422). Next, the routine proceeds to step S423, wherein a judgement is made as to whether the parameter i exceeds [15] or not. While i is less equal than

[15], the routine goes back to step S421. After the operations of steps S421 through S423 are repeated 16 times, the result of judgement in step S423 becomes [YES], whereby the routine proceeds to step S424, wherein a value of [0]is set to time count data area TC, after which control returns to main routine.

Thereafter, every time the movement of joy-stick is detected, the duration data corresponding to the count of sampling periods which has been lapsed since the preceding event has been written at last time and current joy-stick operational data are written to performance memory 4.

When the performer release a key which has being depressed by that time, key-off event of released key is detected by CPU 1. In this case, when the key-off processing routine is executed, the operations of step S271 through. S274 are executed, whereby the forcing dump operation corresponding to released key is carried out, after which the routine proceeds to step S278 via step S275. In step S275, a judgement is made as to whether all of key switches are off state or not. When at least one of key switches is on state, the result of judgement in step S278 is [NO], whereby control returns to main routine. When all of key switches are off state, the result of judgement becomes [YES], the routine proceeds to step S279, wherein the count of sampling periods stored in time count data area TC is written to the memory location of performance memory 4 at address EDPNT as duration data of final event, the contents of data areas VCx and VCy are respectively written to the memory locations of performance memory 4 at addresses (EDPNT+1) and (EDPNT+2) as joy-stick operational data of final event. Next, in step S279, the data of [255] meaning the end of event is written to the memory location of performance memory 4 at address (EDPNT+3).

<Edit mode>

Figure 10:
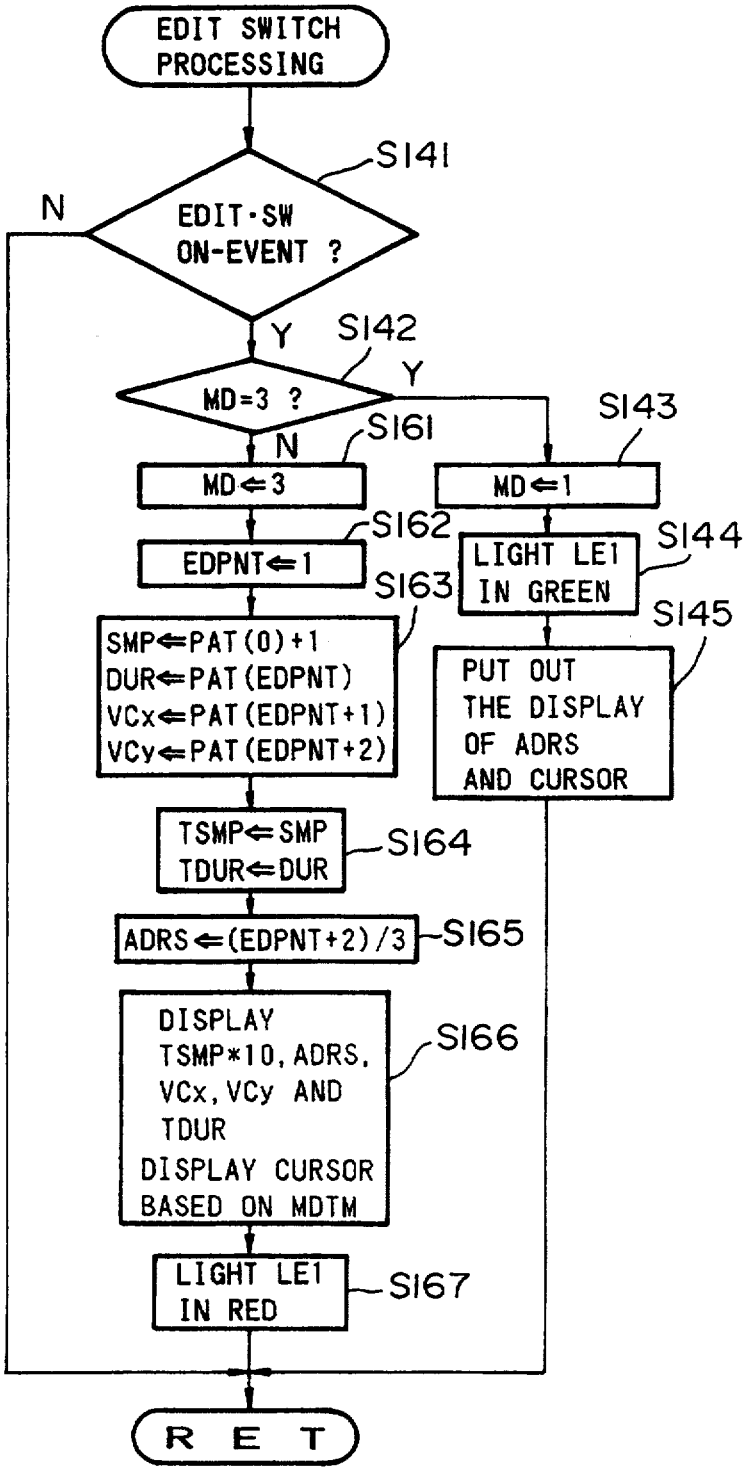
Figure 11:
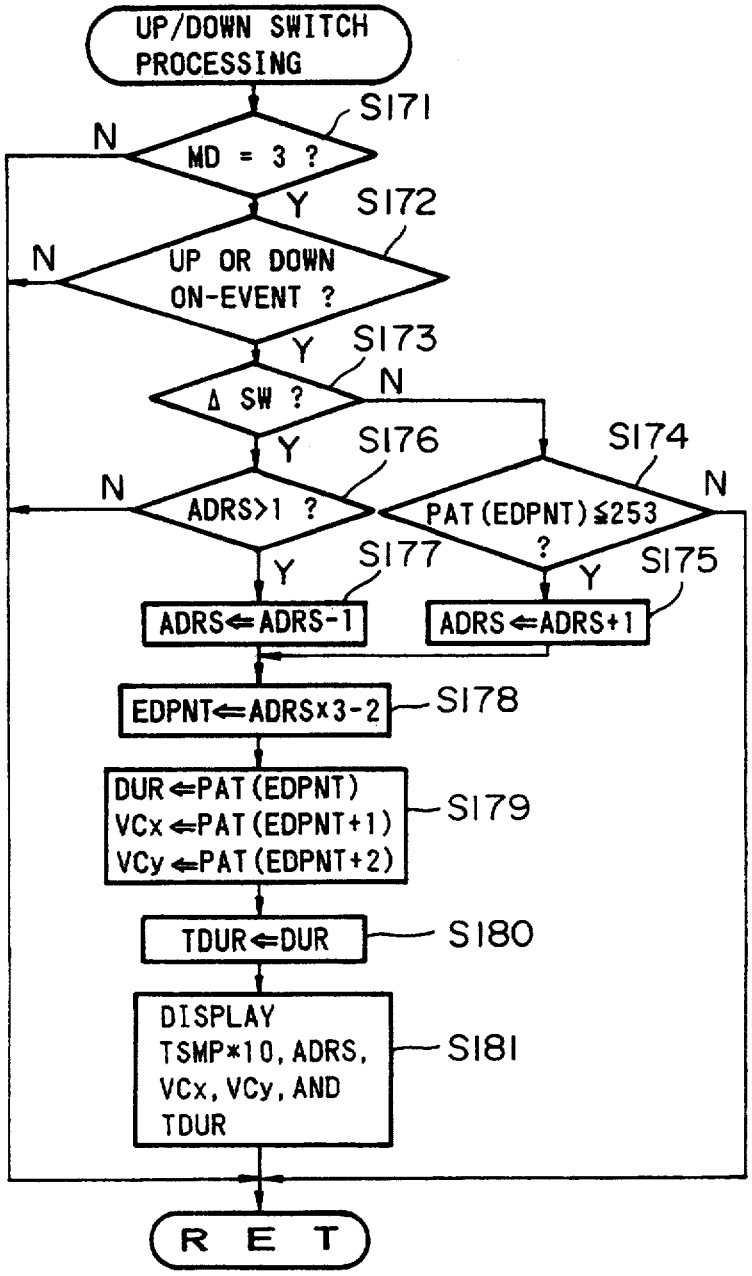
Figure 13:
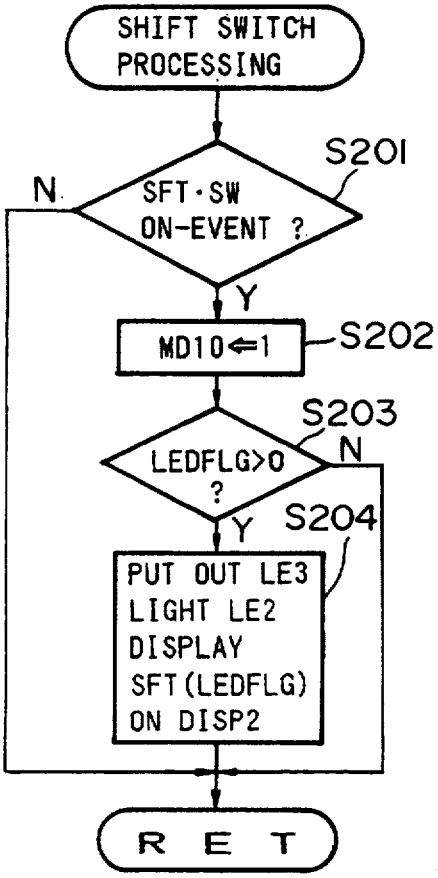
Figure 14:
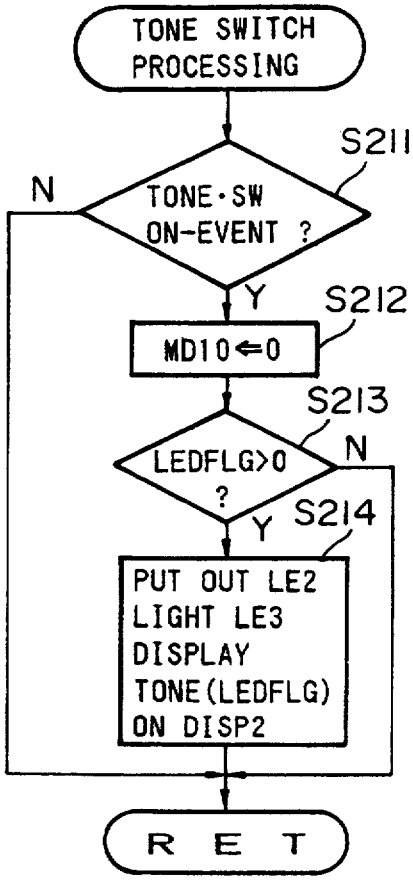
Figure 15:
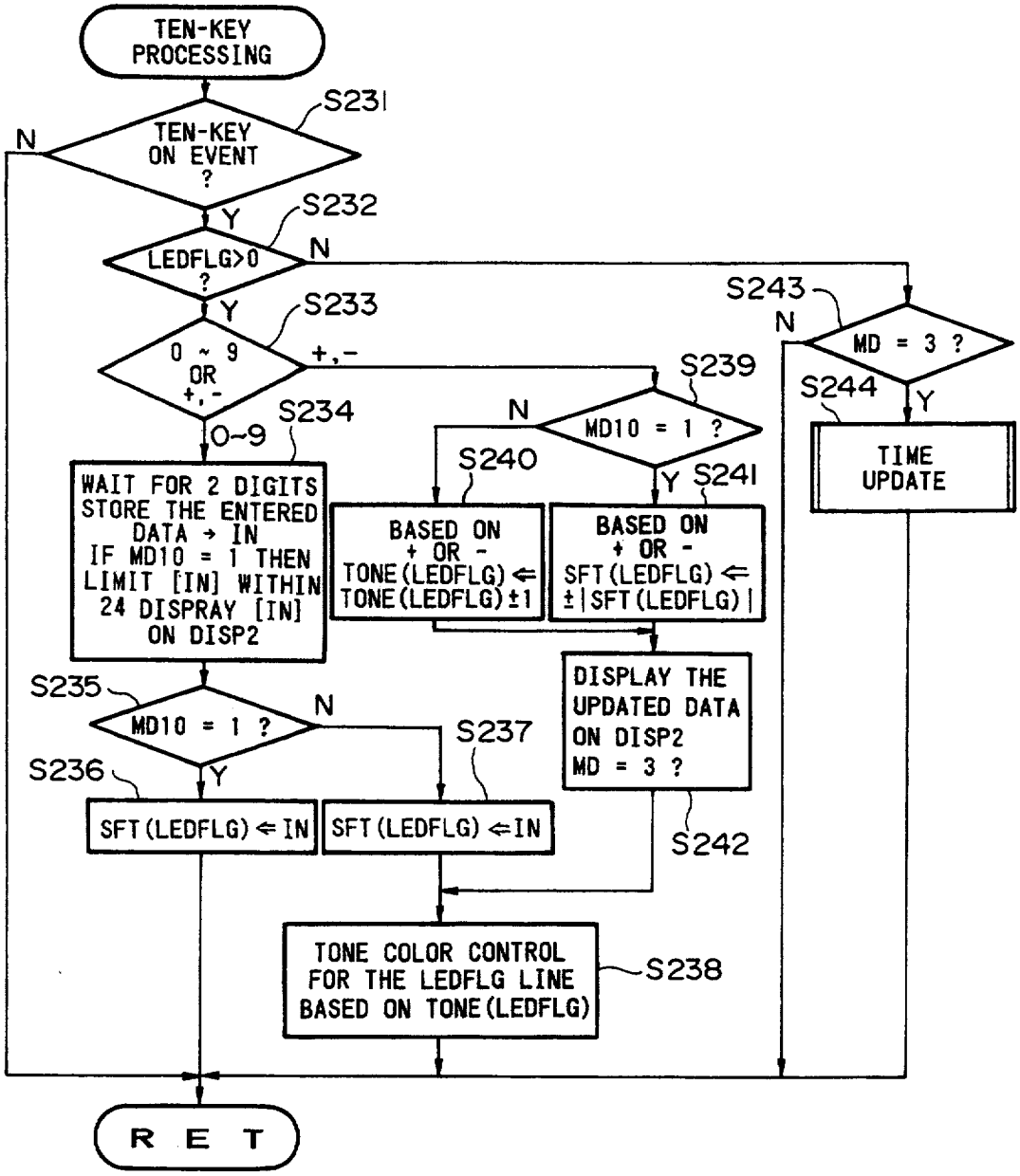
Figure 16:
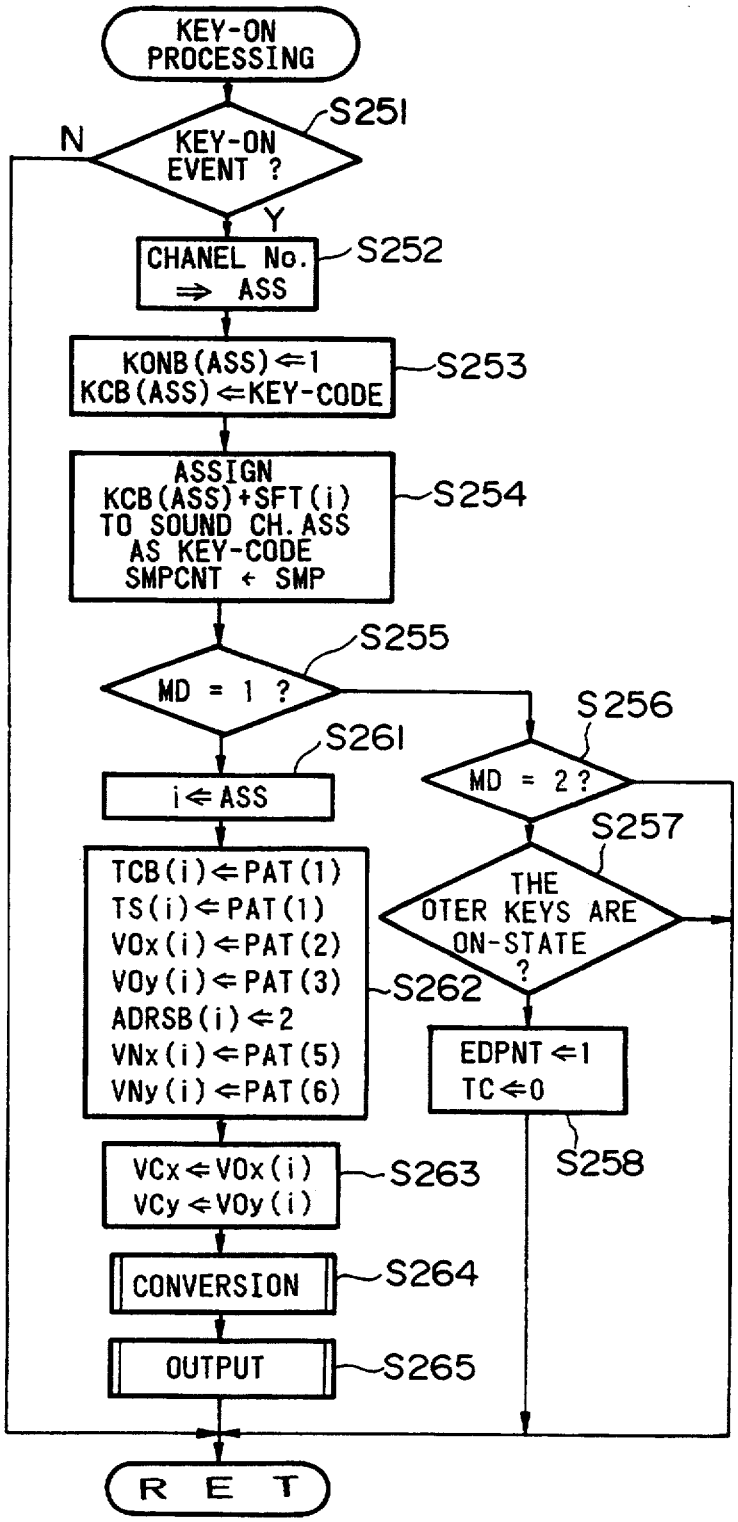
Figure 17:
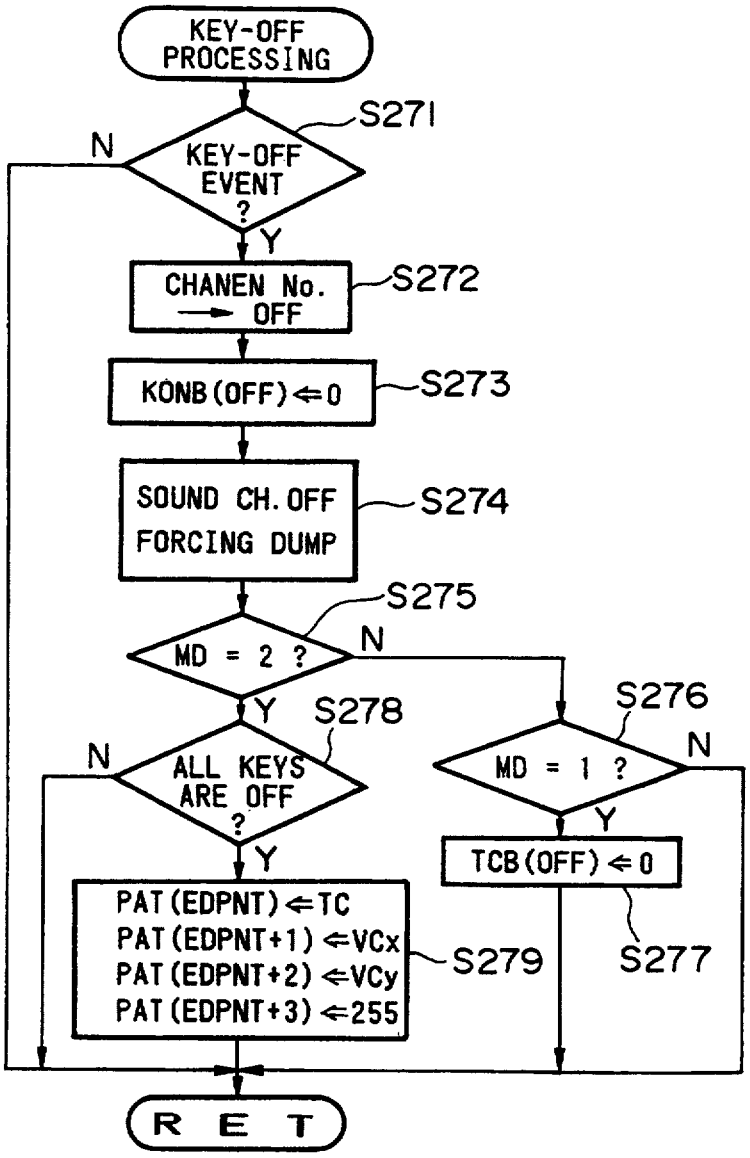
Figure 18:
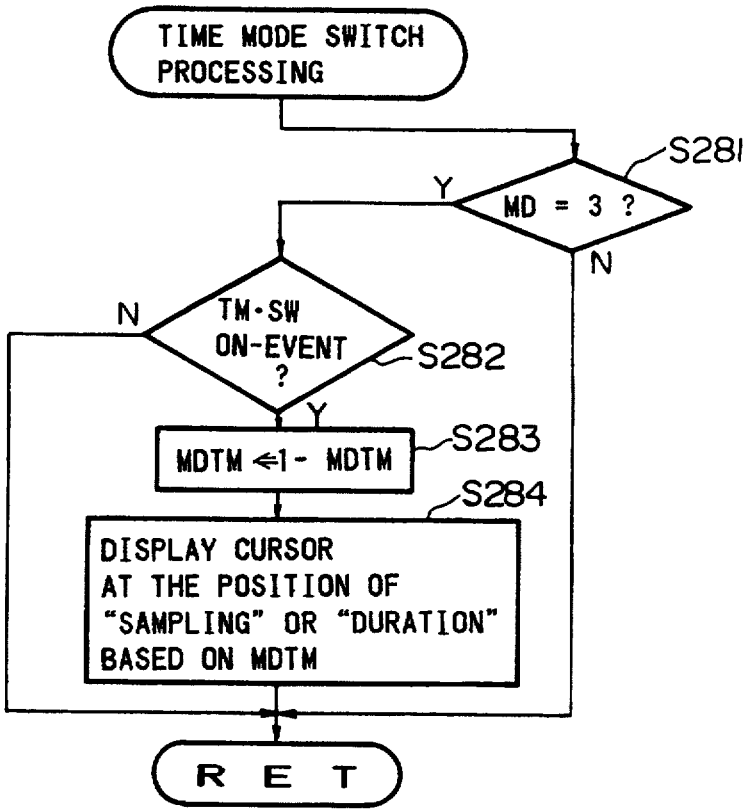

When updating the contents of performance memory 4, the performer depresses the edit switch SW3, thereby operation mode changing to edit mode (MD=[3]). In this case, the operations of steps S161 through S167 of edit switch processing routine shown in flow chart of FIG. 10 is executed. As a result, current sampling period is displayed on the display area AR1 of display DISP1 and also duration data, X-directional and Y-directional joy-stick operational data of first event are respectively displayed on the display areas AR5, AR3 and AR5. Additionally, when MDTM='0', the cursor is displayed on right side area of display area AR5, whereas when MDTM='1', the cursor is displayed on right side area of display area AR1.

Next, the performer depresses the down key #D or up key #U. As a result, when the routine proceeds to the up down switch processing routine via step S5 of main routine, the routine proceeds to step S173 via steps S171 and S172, wherein a judgement is made as to whether the up key #U is on-state or not. When the result of this judgement is [NO], i.e., depressed is down key #D, the routine proceeds to step S174.

In step S174, a event data PAT(EDPNT) is read out from the memory location of performance memory 4 at the address EDPNT, after which a judgement is made as to whether PAT(EDPNT) is equal less than [253] or not. When the result of this judgement is [YES], the routine proceeds to step S175, wherein the event address stored in data area ADRS is incremented by one, after which the routine proceeds to step S178. On the other hand, when the result of judgement in step S174 is [NO], i.e., PAT(EDPNT) is [254] corresponding to the repeat command or [255] corresponding to end of event, control returns to main routine.

When the result of judgement in step S173 is [YES], the routine proceeds to step S176, wherein a judgement is made as to whether the event address stored in data area ADRS is greater than [1] or not. When the result of this judgement is [NO], control returns to main routine, whereas when the result of this judgement is [YES], the routine proceeds to step S177. When the routine proceeds to step S177, the event address stored in data area ADRS is decremented by one, after which the routine proceeds to step S178.

In step S178, the event address stored in data area ADRS being read out, the read out event address being multiplied by [3], after which the result of this multiplication is decremented by [2], whereby the address for first byte of corresponding event is obtained, after which the obtained address is stored in address pointer EDPNT. Next in step S179, the duration data stored in the memory location of performance memory 4 at address EDPNT is written to the duration data area DUR, and also the X-directional and Y-directional joy-stick operational data stored in the memory locations of performance memory 4 at addresses (EDPNT+1) and (EDPNT+2) are respectively written to the data areas VCx and VCy. Next, the routine proceeds to step S180, wherein the content of DUR is stored in the data area TDUR, after which the routine proceeds to step S181, wherein the contents of data areas ADRS, VCx, VCy and TDUR are respectively displayed on the corresponding display areas of the display DISP1. After completion of step S181, control returns to main routine. In this manner, the performer can set the desired addresses in data areas ADRS, EDPNT by operating the down key #D or the up key #U.

Meanwhile, in edit mode, when the content of mode flag MDTM is '1', sampling period can be updated, whereas when the content of mode flag MDTM is '0', the duration data of desired event can be updated. When the performer wishes to change the type of data to be updated from the present state, he depresses the time mode switch SW5. By this operation, when the routine proceeds to a time mode switch processing routine shown in flow chart of FIG. 18 via step S12 of main routine, the routine proceeds to step S282 via step S281, wherein a judgement being made as to whether the time mode switch has been depressed or not, the result of this judgement is [YES], thereby proceeding to step S283, therein inverting the logical value '1'/'0' of mode flag MDTM. Next in step S284, when MDTM='1', the cursor is displayed on right side of the display area AR1, whereas when MDTM='0', the cursor is displayed on right side of the display area AR5. After completion of step S284, control returns to main routine. In addition, when the operation mode is not edit mode, the result of judgement in step S281 is [NO], whereby control returns to main routine, i.e., the operation applied to time mode switch SW5 is ignored.

Figure 19:
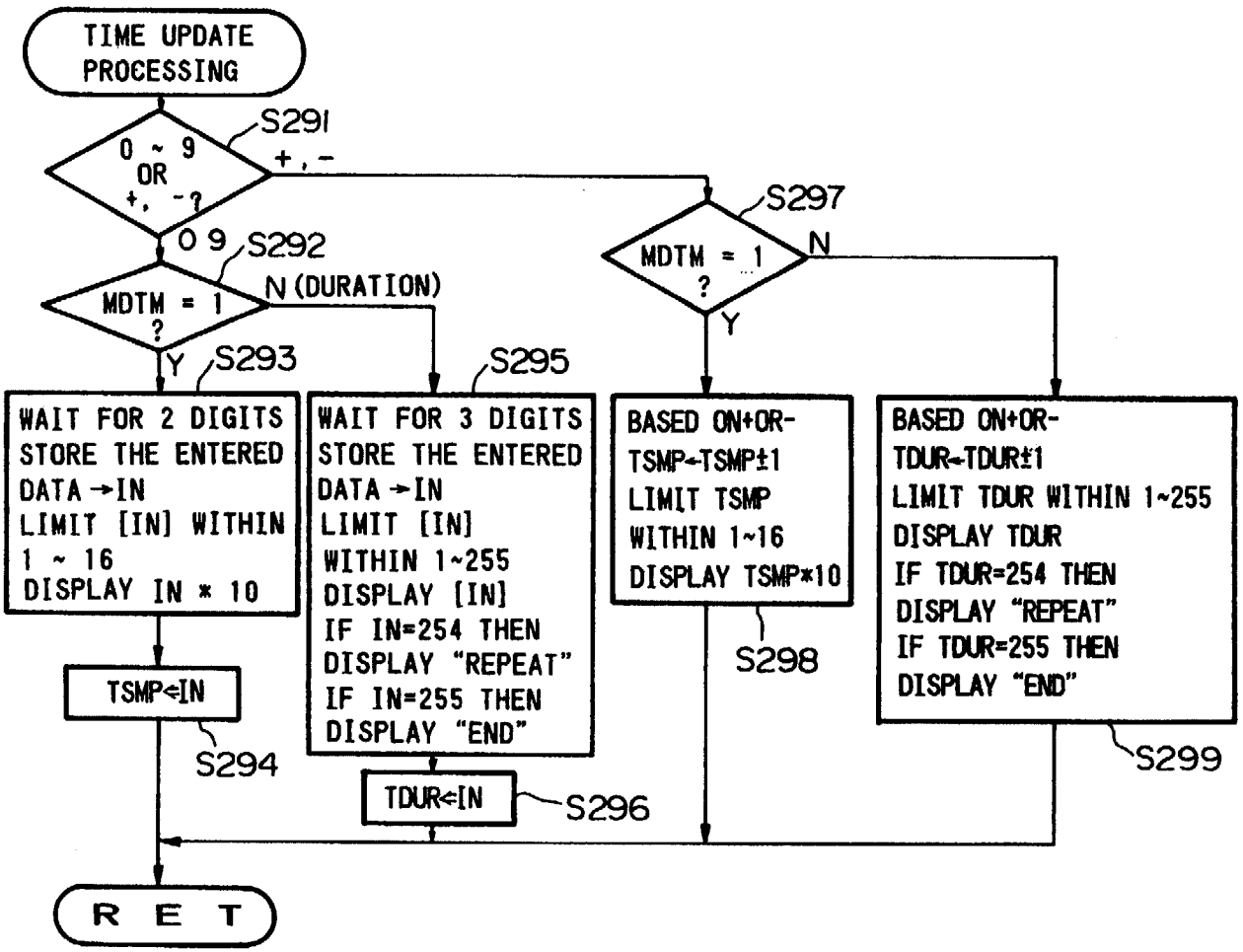
Figure 20:
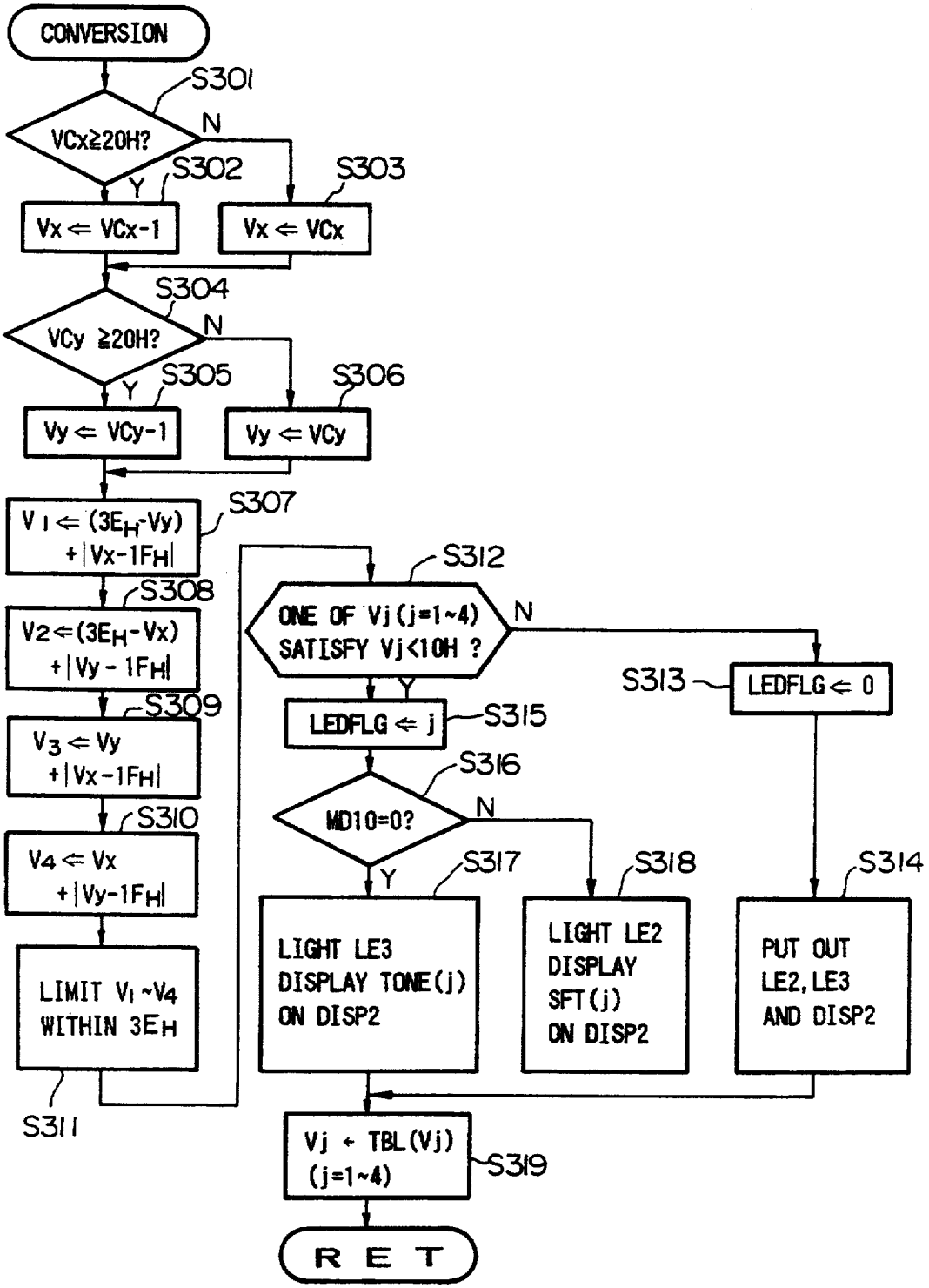

Next, the performer operates the ten-keys #0 through #9, add key #A or subtract key #S. As a result, when the ten-key processing routine is executed, the routine proceeds to step S232 via step S231, wherein a judgement is made as to whether the content of line designating data area LEDFLG is greater than [0] or not. When joy-stick is not turned strongly and rightly enough to determine LEDFLG, and LEDFLG=[0], a result of this judgement is [NO], whereby the routine proceeds to step S243, wherein a judgement is made as to whether the content of MD is [3] or not. In this case, the content of MD is [3], thus, the result of judgement in step S243 is [YES], whereby the routine proceeds to step S244, wherein a time update processing routine shown in flow chart of FIG. 19 is executed.

In step S291, a judgement is made as to whether depressed is one of the ten-keys #0 through #9 or one of the add key #A and subtract key #S. When depressed is one of ten-keys, the routine proceeds to step S292, wherein a judgement is made as to whether the content of mode flag MDTM is '1' or not. When the result of this judgement is [YES], the routine proceeds to step S293, wherein CPU 1 waits for the completion of entering the 2 digits numerical data by ten-key operation. When 2 digits numerical data has be entered, the entered data is set to data area IN, after which when the content of data area IN exceeds the regular range of [0] through [16], the content of data area IN is limited within the regular range. Additionally, the numerical data which is obtained by multiplication of 10*IN is displayed on the display area AR1 of display DISP1. Next, in step S294, wherein the content of data area IN is stored in the data area TSMP. After completion of step S294, control returns to main routine via ten-key processing routine.

On the other hand, when the result of judgement in step S292 is [NO], the routine proceeds to step S295, wherein CPU 1 waits for the completion of entering 3 digits numerical data by ten-key operation. When 3 digits numerical data has been entered, the entered data is set to data area IN, after which when the content of data area IN exceeds the regular range of [1] through [255], the content of data area IN is limited within the regular range. Additionally, the content of data area IN displayed on the display area AR5 of display DISP1. Further, in the case where IN=[254], 'Repeat' is displayed on right side of display area AR5, while in the case where IN=[255], 'End' is displayed therein. Next, in step S296, wherein the content of data area IN is stored in the data area TDUR. After completion of step S296, control returns to main routine via ten-key processing routine.

When the performer depresses the add key #A or subtract key #S, the routine proceeds to step S297 via step S291, wherein a judgement is made as to whether MDTM='1' or not. When MDTM='1', the routine proceeds to step S298. In step S298, when depressed is the add key #A, the content of data area TSMP is incremented by one, whereas when depressed is the subtract key #S, the content of TSMP is decremented by one. After which, when the result of increment operation or decrement operation exceeds the regular range of [1] through [16], the content of TSMP is limited within the regular range. And then, the numerical data which is obtained by the multiplication of TSMP*10 is displayed on the display area AR5. And then, control returns to main routine.

On the other hand, in the case where the result of judgement in step S297 is [NO], the routine proceeds to step S299. In step S299, when depressed is the add key #A, the content of data area TDUR is incremented by one, whereas when depressed is the subtract key #S, the content of data area TDUR is decremented by one. After which, when the result of increment operation or decrement operation exceeds the regular range of [1] through [255], the content of TDUR is limited within the regular range. And then, the content of data area TDUR is displayed on the display area AR5. Additionally, in the case where IN=[254], 'Repeat' is displayed on right side of display area AR5, while in the case where IN=[255], 'End' is displayed therein. And then, control returns to main routine.

In edit mode, the performer can not only update the timing data such as sampling period or duration data, but also update X-directional and Y-directional joy-stick operational data. In order to update the joy-stick operational data, the performer moves the joy-stick to desired operation position. In .this case, when the timer interrupt routine shown in flow chart of FIG. 24 is executed, new X-directional and Y-directional joy-stick operational data being respectively stored in data areas ADx and ADy (step S401), the contents of data areas ADx and ADy are respectively displayed on the display areas AR3 and AR4 (step S402). Next in step S403, for reason of MD=[3], the result of judgement in step S403 is [YES], whereby the operations of steps S404 through S409 are executed as similar to the manual stick mode. By these processing, the volume control for the first through fourth musical tones is carried out based on the position of joy-stick. And then, the performer depressing desirable key of key-board to cause the tone generator 8 sound the first through fourth musical tone, and verifies whether the tone volume condition of 4 lines musical tones satisfies his requirement or not.

In this manner, the processing for updating desired data area being carried out, the data which is desired for the performer, i.e., desired sampling period, desired duration data and desired joy-stick operational data are displayed on the display area DISP1. When displayed data satisfy the requirement of performer, the performer depresses set switch SW4, whereby the switch-on event corresponding to set switch SW4 is detected by CPU 1. As a result, when the routine proceeds to the set switch processing routine in flow chart of FIG. 12 via step S6 of main routine, the routine proceeds to step S191, wherein a judgement being made as to whether MD=[3] or not, the result of this judgement is [YES], thereby proceeding to step S192, wherein a judgement being made as to whether the set switch has been depressed or not, the result of this judgement is [YES], thereby proceeding to step S193. In step S193, the content of TDUR is stored in the memory location of performance memory 4 at address EDPNT and the contents of data area VCx and VCy are respectively stored in the memory locations of performance memory 4 at addresses (EDPNT+1) and (EDPNT+2). Next, in step S194, the data which is obtained by subtraction of TSMP-[1] is stored in the memory location of performance memory 4 at address [0]. After completion of step S194, control returns to main routine. Additionally, when the operation mode is not edit mode, i.e., MD is not [3], the routine returns to main routine via step S191, i.e., the operation applied to set switch SW4 is ignored.

<Regeneration mode>

Figure 22:
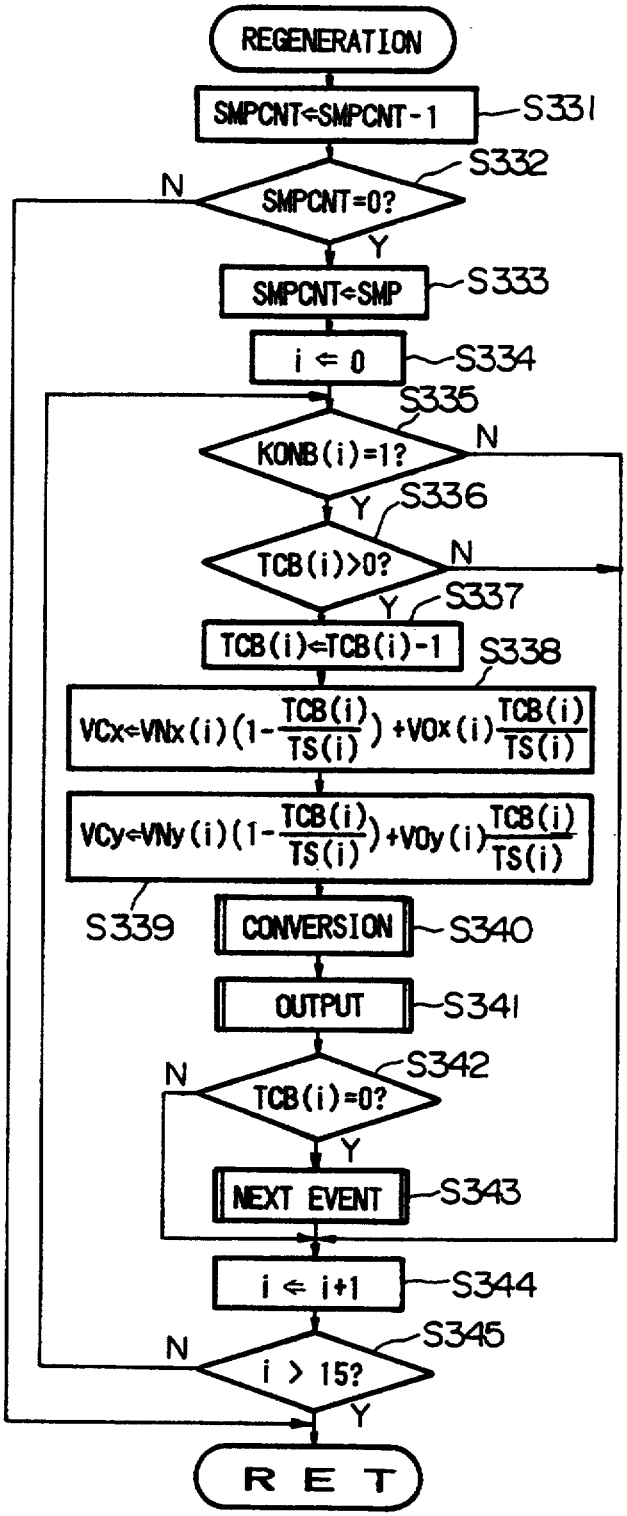

In regeneration mode (MD=[1] ), when the timer interrupt routine shown in flow chart of FIG. 24 is executed, the routine proceeds to step S425 via steps S401 through S403 and S410, wherein a regeneration routine shown in flow chart of FIG. 22 is executed. In step S331 of regeneration routine, the content of sampling period count data area SMPCNT is decremented by one. Next, in step S332, a judgement is made as to whether SMPCNT=[0] or not. When the result of this judgement is [NO], control returns to main routine via timer interrupt routine. Thereafter, while SMPCNT is not [0], the content of data area SMPCNT is decremented by one, every time the regeneration routine is executed via timer interrupt routine. When the routine proceeds to judgement step S332 and the result of that is [YES], the routine proceeds to step S333, wherein the data stored in data area SMP and corresponding to sampling period is set to data area SMPCNT, after which the routine proceeds to step S334. In this manner, the operations on and after step S334 are executed when the time which consists of plural sampling periods elapses, wherein the number of sampling periods is designated by SMP.

In step S334, a value of [0] is set to parameter i. Next, in step S335, a judgement is made as to whether the content of KONB(i) is '1' or not. When the result of this judgement is [NO], the routine proceeds to step S334, wherein the parameter i is decremented by one. Next in step S345, a judgement is made as to whether parameter i exceeds to [15] or not. When the result of this judgement is [NO], the routine returns to step S335. While no key of key-board is depressed by performer, the result of judgement in step S335 is [NO], so the operations of step S335 and S344 are repeatedly executed. As a result, the parameter i reaches to [0], whereby control returns to main routine via timer interrupt routine.

When the performer depresses one of keys on key-board, corresponding key-on event is detected by CPU 1. As a result, the operations of steps S251 through S254 of key-on processing routine are executed, whereby sound process for generating the musical tone having the key-code designated by detected key-on event and also the content of data area SMP is set to data area SMPCNT, after which the routine proceeds to step S261 via step S255. In step S261, a channel number stored in data area ASS and corresponding to sound channel which is assigned for the musical tone generation ordered by depressed key is set to the parameter i.

Next, the routine proceeds to step S262, wherein a duration data of first event is read out from the memory location of performance memory 4 at address [1] being read out, after which the read out duration data is written to data area TCB at entry i and also written to data area TS at entry i. Additionally in step S262, X-directional and Y-directional joy-stick operational data of first event are read out from the memory locations of performance memory 4 at addresses [2] and [3], after which the read out data are respectively stored in the data area VOx at entry i and the data area VOy at entry i. In addition, a value of [2] is set to data area ADRSB at entry i. Further, from the memory locations of performance memory 4 at addresses [5] and [6], X-directional and Y-directional joy-stick operational data of second event are read out, after which the read out data are respectively stored in data area VNx at entry i and data area VNy at entry i. Next, in step S263, the contents of data area VOx at entry i and data area VOy at entry i are respectively stored in data areas VCx and VCy. Next, the routine proceeds to step S264, wherein the conversion routine shown in flow chart of FIG. 20 being executed, the routine proceeding to step S265, wherein the output routine shown in flow chart of FIG. 21 being executed, whereby the tone volume control for respective line musical tones is carried out based on the contents of data areas VCx and VCy. After completion of these processing, control returns to main routine.

Thereafter, every time the regeneration routine is executed through the timer interrupt routine by interval of 10[ms]. In the case where the content of sampling count data area SMPCNT reaches to [0], i.e., every time the sampling period designated by SMP has elapses, the result of judgement in step S332 becomes [YES], whereby the routine proceeds to step S335 via steps S333 and S334. When the routine proceeds to step S335, therein a judgement is made as to whether the content of KONB(i) is '1', i.e., the sound channel No. i is used for the musical tone generation or not. When the result of this judgement is [NO], the routine proceeds to step S344, therein parameter i is incremented by one. While in the case where the sound channel No. i is used for the musical tone generation, the result of judgement in step S335 is [YES], whereby the routine proceeds to step S336. In step S336, a judgement being made as to whether the content of TCB(i) is [0] or not, when the result of this judgement is [YES], the routine proceeds to step S337, whereas when the result of this judgement is [NO], the routine proceeds to step S344, thereby parameter i being incremented. When the routine proceeds to step S337, therein the content of TCB(i) is decremented by one. After which the operations of steps S338 and S339 are executed, whereby the calculations according to following equations (9) and (10) are carried out.

$$VCx = VNx(i)[1-\{TCB(i)/TS(i)\}] + VOx(i)\{TCB(i)/TS(i)\} \quad (9)$$

$$VCy = VNy(i)[1-\{TCB(i)/TS(i)\}] + VOy(i)\{TCB(i)/TS(i)\} \quad (10)$$

Figure 26:
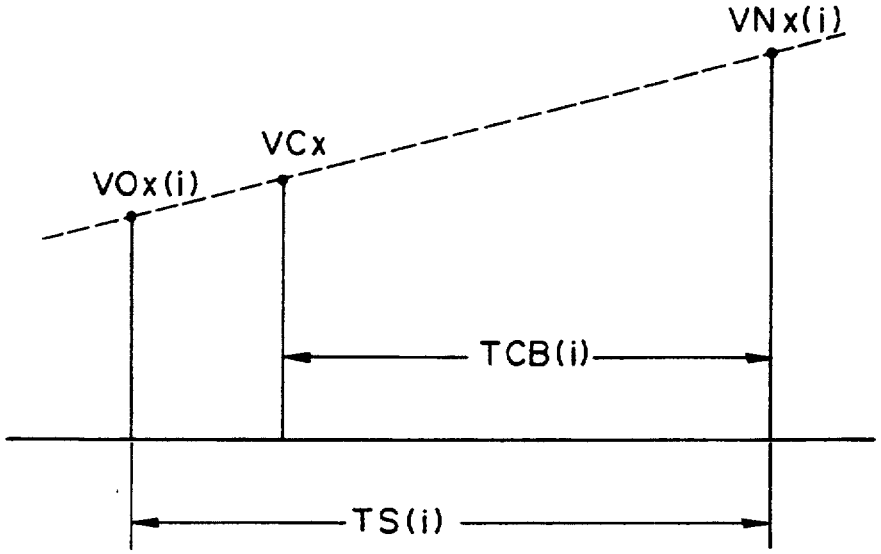
FIG. 26 shows an interpolation method applied to joy-stick operational data which is used for the preferred embodiment shown in FIG. 1.

In the above equation (9), VOx(i) is X-directional joy-stick operational data of current event which is regenerated at this time; VNx(i) is X-directional joy-stick operational data of next event which will be regenerated at next time; TS(i) is the duration data of current event; TCB(i) corresponds to remaining time which is remained until the time when the next event will be regenerated. Thus, according to the equation (9), X-directional joy-stick operational data VCx shown in FIG. 26 which is to be applied to tone volume control at current time is interpolated over time, after which the result of interpolation calculation is stored in data area VCx. Similarly, by executing the calculation according to equation (10), Y-directional joy-stick operational data which is to be applied to tone volume control at current time is interpolated and stored in data area VCy. Next, in step S340, the conversion routine (FIG. 20) is executed, after which the routine proceeds to step S341, wherein the output routine (FIG. 21) is executed, whereby tone volume control for respective line musical tone which are sounded by tone generator 8 at sound channel No. i is carried out.

Next, the routine proceeds to step S342, wherein a judgement is made as to whether TCB(i)=[0] or not. When the result of this judgement is [YES], the routine proceeds to step S344, wherein the parameter i is incremented. While i is less equal than [15], the routine returns to step S335.

Figure 23:
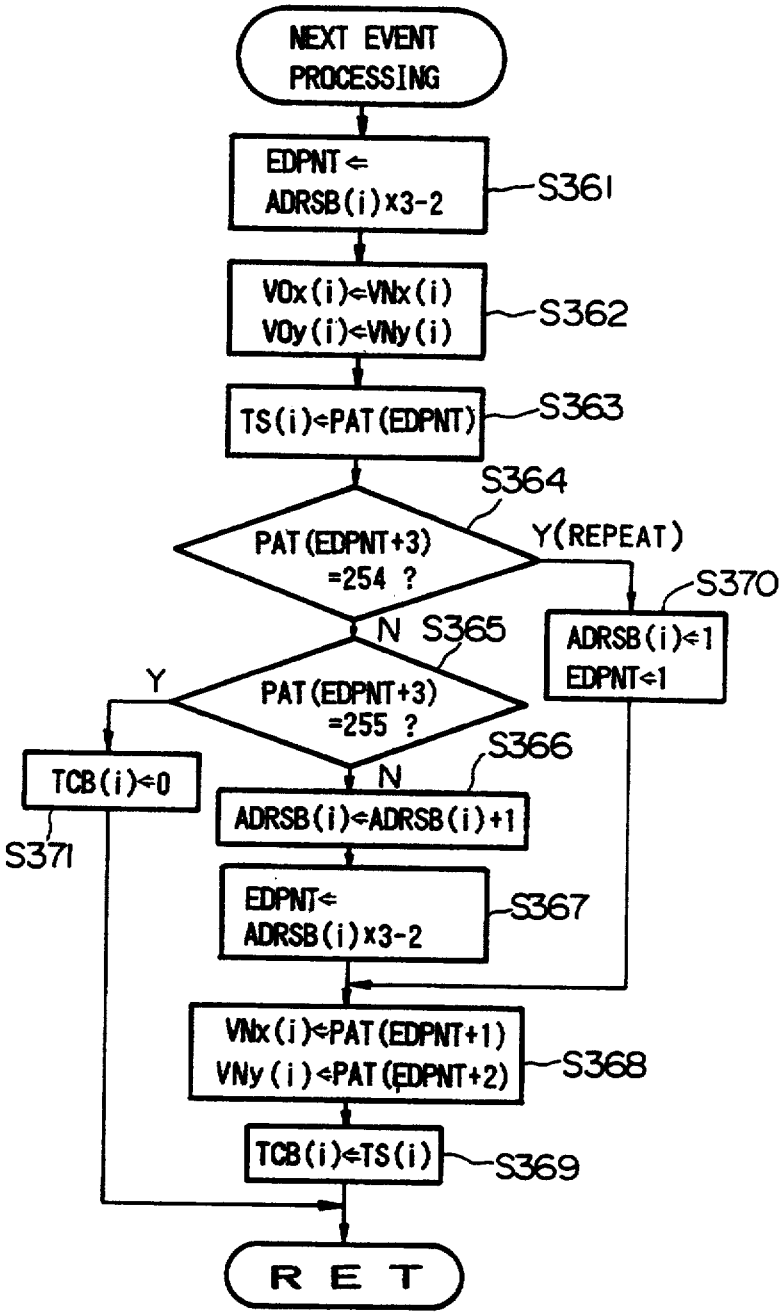

When the content of TCB(i) corresponding to sound channel No. i reaches to [0] by that the regeneration routine is repeatedly executed via timer interrupt routine, in this case, the result of judgement in step S342 is [YES], whereby the routine proceeds to step S343, wherein a next event processing routine shown in flow chart of FIG. 23 is executed.

In step S361, the event address corresponding to next event continued to regenerated event being read out from data area ADRSB at entry i, the read out event address being multiplied by [3], the result of this multiplication being subtract by [2], the result of subtraction is set to address pointer EDPNT. Next, in step S362, the content of VNx(i) is set to VOx(i) and also the content of VNy(i) is set to VOy(i). Next, in step S363, the duration data is read out from the memory location of performance memory 4 at address EDPNT, after which the read out duration data is set to TS(i).

Next, the routine proceeds to step S364, wherein data is read out from the memory location of performance memory 4 at address (EDPNT+3) as data PAT(EDPNT+3), after which a judgement is made as to whether the read out data PAT(EDPNT+3) is coincidence with [254] or not. When the result of this judgement is [NO], the content of ADRSB(i) is incremented by one (step S366), after which the data which is obtained by calculation of 3*ADRS(i)−[2] is set to address pointer EDPNT (step S367). Next, in step S368, X-directional and Y-directional joy-stick operational data are respectively read out from the memory locations of performance memory 4 at addresses (EDPNT+1) and (EDPNT+2), after which the read out data are respectively stored in VNx(i) and VNy(i). Next, the content of TS(i) is set to TCB(i) (step S369), after which control returns to regeneration routine. On the other hand, in the case where the result of judgement in step S365 is [YES], i.e., the current event data is final event data, a value of [0] is set to TCB(i) (step S371), after which control returns to the regeneration routine. Additionally, in the case where the result of judgement in step S364 is [YES], i.e., the content of PAT(EDPNT+3) is [254] which is code of the repeat command, the routine proceeds to step S370, wherein a value of [1] is set to ADRSB(i) and also is set to EDPNT for the reason of that the event to be regenerated at next time is the first event stored in performance memory 4. After completion of step S370, the operations of steps S368 and S369 are executed.

As described above, for each one of sound channels which are sounding the musical tone, event data being sequentially read out from performance memory 4, the volume control based on the read out event data is carried out on respective lines of tone generating circuits of tone generator 8.

When the performer releases the key which has be depressed, the key-off event corresponding to released key is detected by CPU 1. As a result, when the routine proceeds to the key-off processing routine, wherein the operations of steps S271 through S274 are executed, thereby the forcing dump operation for released key being carried out, after which the routine proceeds to step S277 via steps 275 and S276. In step S277, a value of [0] is set to data area TCB at entry OFF which corresponds to sound channel on which the forcing dump operation is carried out. After completion of step S277, control returns to main routine. By these operations as described above, the musical tone corresponding to released key is stopped. However, in the case where there is at least one key which is depressed at this time, by executing the regeneration routine via timer interrupt routine, the tone volume control based on the event data stored in performance memory 4 is carried out on the musical corresponding to the depressed key at current time. And then, when a new key is depressed, the the musical tone generation for new depressed key is carried out, wherein the event data being sequentially read out from performance memory 4, the tone volume control for respective line musical tones based on read out event data is carried out.

In the above described preferred embodiment of the present invention, a suitable of a tone volume control for controlling the pan-pot of musical tone in real time manner is described. However, the present invention should not be considered to be so limited. For example, in a suitable implementation of control for musical tone, acoustic reverberation, tone pitch, pan-pot and the like could be controlled in response to operation allied to joy-stick in real time manner. In this case, plural musical tone parameters could be controlled in response to same operation applied to joy-stick. On the other hand, one of the musical tone parameter being selected, after which selected musical tone parameter could be controlled in response to operation applied to joy-stick. Additionally, in the above described preferred embodiment of the present invention, tone shift data can be set for desired line of musical tone in independent manner, however, in another implementation, the other parameters such as pan-pot, effect could be set for each one of lines of musical tones. Further, in another implementation, the dynamic range for setting the value of parameter used for controlling the musical tone can be varied as desired. According to this implementation, the valuation of performance can become very larger.

Additionally, in the above described preferred embodiment of the present invention, repeat number of sampling time corresponding to interval time is displayed in exchange for actual interval time, however in a suitable implementation, actual duration could be displayed by the suitable processing, i.e., the first processing in which that the duration data is multiplied by the sampling period and the second processing in which the result of multiplication is displayed as actual interval time.

Further, in the above described preferred embodiment of the present invention, a series of event data corresponding to one pattern is stored in performance memory 4, however in a suitable implementation, plural series of event data corresponding to respective patterns could be stored in performance memory 4, whereby the operation characteristics could be more improved.

In addition, in the above described preferred embodiment of the present invention, a example of repeat regeneration of event is described, however the present invention should not be considered to be so limited with respect to the method of repeat regeneration of event. For example, in a suitable implementation for repeat regeneration, a series of events which correspond to desired period between the head event and final event could be repeatedly regenerated. Various repeat regeneration methods can be applied to the present invention.

Further, the present invention should not be limit the operation factor for controlling musical tone parameter. For example in another implementation, desired operation factor such as volume and the like are applied to the present invention.

Further more, in the above described preferred embodiment of the present invention, during the next event data will be regenerated, the interpolation operation based on the current event data and next event data is carried out by using linear interpolation method. However, the interpolation method can be selected at will in response to desired accuracy.

Additionally, in the above described preferred embodiment of the present invention, the electronic musical instrument having performance memory 4 is described. However, the present invention can be applied to the other types of electronic musical instrument which has no performance memory. For example, in a suitable implementation, operational data corresponding to joy-stick operational data used in present embodiment could be supplied from another external apparatus of the electronic musical instrument, and also could be supplied by waveform generator which can generate the waveform having the desired shape. In these case, the musical tone could be varied in response to the supplied operational data.

What is claimed is:

1. An electronic musical instrument comprising:

musical tone designating means for designating a musical tone to be generated;

an operator element for designating a characteristic of a musical tone, said operator element sequentially generating operational data which determine the characteristic of the musical tone based on an operation applied thereto;

memory means for storing the operational data;

mode setting means for setting a recording mode and a reproducing mode;

writing means for sequentially writing said operational data in the memory means as it is generated by the operator element, when in the recording mode;

read-out means for sequentially reading out the stored operational data from said memory means in the order written therein, after a musical tone to be generated is designated by said musical tone designating means when in the reproducing mode; and tone generating means for generating a musical tone designated by said musical tone designating means based on the operational data sequentially read-out by said read-out means so that the characteristic of the musical tone generated by the tone generating means varies over time according to the variation in time of the operational data sequentially read-out.

2. An electronic musical instrument according to claim 1, further comprising:

means for setting desired timing data; and wherein said operational data stored in said memory means are consecutively read out and used for determining the characteristics of a musical tone to be generated every time an interval corresponding to said timing data elapses.

3. An electronic musical instrument according to claim 2, further comprising:

interpolation means for carrying out an interpolation calculation over time by using plural operational data stored in said memory means; and wherein said tone generating means generates said musical tone based on the interpolated operational data.

4. An electronic musical instrument according to claim 1, wherein said tone generating means includes plural tone forming means, each for forming a musical tone, and the tone generation operation of each tone forming means is controlled based on said operational data.

5. An electronic musical instrument according to claim 4, wherein the intensity of the musical tone generated by each tone forming means is controlled based on said operational data.

6. An electronic musical instrument comprising:

musical tone designating means for designating a musical tone to be generated;

an operator element for designating a characteristic of a musical tone, said operator element sequentially generating operational data which determine the characteristic of the musical tone based on an operation applied thereto;

memory means for storing the operational data;

mode setting means for setting a recording mode and a reproducing mode;

writing means for sequentially writing said operational data in the memory means when in the recording mode;

read-out means for sequentially reading out the stored operational data from said memory means after a musical tone to be generated is designated by said musical tone designating means when in the reproducing mode;

tone generating means for generating a musical tone designated by said musical tone designating means based on the operational data sequentially read-out by said read-out means so that the characteristic of the musical tone generated by the tone generating means varies over time according to the variation in time of the operational data sequentially read-out;

triggering means for generating a triggering signal; and wherein the readout of the stored operational data from said memory means and the generation of a musical tone by said tone generating means based on said operation data commence in response to said triggering signal.

7. An electronic musical instrument comprising:

musical tone designating means for designating a musical tone to be generated;

an operator element for designating a characteristic of a musical tone, said operator element sequentially generating operational data which determine the characteristic of the musical tone based on an operation applied thereto;

memory means for storing the operational data;

mode setting means for setting a recording mode and a reproducing mode;

writing means for sequentially writing said operational data in the memory means when in the recording mode;

read-out means for sequentially reading out the stored operational data from said memory means after a musical tone to be generated is designated by said musical tone designating means when in the reproducing mode;

tone generating means for generating a musical tone designated by said musical tone designating means based on the operational data sequentially read-out by said read-out so that the characteristic of the musical tone generated by the tone generating means varies over time according to the variation in time of the operational data sequentially read-out;

means for setting desired timing data; and wherein said operational data are consecutively written in said memory means every time an interval corresponding to said timing data elapses.

8. An electronic musical instrument according to claim 6, wherein the writing operation in said memory means is started at the time when said triggering signal is generated.

9. An electronic musical instrument comprising:

musical tone designating means for designating a musical tone to be generated;

an operator element for designating a characteristic of a musical tone, said operator element sequentially generating operational data which determine the characteristic of the musical tone based on an operation applied thereto;

memory means for storing the operational data;

mode setting means for setting a recording mode and a reproducing mode;

writing means for sequentially writing said operational data in the memory means when in the recording mode;

read-out means for sequentially reading out the stored operational data from said memory means after a musical tone be generated is designated by said musical tone designating means when in the reproducing mode;

tone generating means for generating a musical tone designated by said musical tone designating means based on the operational data sequentially read-out by said read-out means so that the characteristic of the musical tone generated by the tone generating means varies over time according to the variation in time of the operational data sequentially read-out; and said operator element being a stick type operator and generating said operational data which indicate a position of said stick type operator.

* * * * *